US009633638B2

(12) United States Patent
Lim et al.

(10) Patent No.: US 9,633,638 B2
(45) Date of Patent: Apr. 25, 2017

(54) METHOD AND APPARATUS FOR SIMULATING A MUSICAL INSTRUMENT

(71) Applicant: Samsung Electronics Co., Ltd., Gyeonggi-do (KR)

(72) Inventors: Chung-Ryeol Lim, Daegu (KR); Sang-Kyu Park, Chungcheongnam-do (KR); Young-Woo Jin, Daegu (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/818,421

(22) Filed: Aug. 5, 2015

(65) Prior Publication Data

US 2016/0042727 A1 Feb. 11, 2016

(30) Foreign Application Priority Data

Aug. 6, 2014 (KR) ..... 10-2014-0101007

(51) Int. Cl.
*G10H 1/18* (2006.01)
*G10H 1/34* (2006.01)
*G10H 1/00* (2006.01)

(52) U.S. Cl.
CPC ..... *G10H 1/34* (2013.01); *G10H 1/0058* (2013.01); *G10H 1/18* (2013.01); *G10H 2220/106* (2013.01); *G10H 2220/241* (2013.01); *G10H 2220/441* (2013.01); *G10H 2220/455* (2013.01); *G10H 2240/175* (2013.01); *G10H 2240/251* (2013.01); *G10H 2240/305* (2013.01)

(58) Field of Classification Search
CPC ..... G10H 1/18; G10H 2220/441
USPC ..... 84/615, 653
See application file for complete search history.

(56) References Cited

U.S. PATENT DOCUMENTS 6,995,310 B1 * 2/2006 Knapp ..... G09B 5/065 84/462
8,866,846 B2 * 10/2014 Kim ..... G10H 1/24 345/173
2004/0031377 A1 * 2/2004 Oshiyama ..... G06F 17/30749 84/602
2005/0196131 A1 * 9/2005 Narusawa ..... G10H 1/46 386/241
2006/0045276 A1 * 3/2006 Gamo ..... H04S 7/30 381/17
2006/0084218 A1 * 4/2006 Lee ..... G10H 1/0008 438/201
2006/0179160 A1 8/2006 Uehara et al.
2008/0208740 A1 * 8/2008 Uehara ..... G06Q 20/102 705/40
2009/0114079 A1 * 5/2009 Egan ..... G09B 15/023 84/477 R (Continued)

FOREIGN PATENT DOCUMENTS

KR 10-2004-0064957 A 7/2004
KR 10-1153333 B1 6/2012

*Primary Examiner* — David Warren
(74) *Attorney, Agent, or Firm* — Cha & Reiter, LLC

(57) ABSTRACT

An apparatus is provided for simulating a musical instrument, comprising: a display configured to present a musical interface associated with an external image; a musical instrument setter configured to associate the musical interface with the musical instrument; and a sound area controller configured to arrange a portion of the musical interface as a sound area.

16 Claims, 26 Drawing Sheets

(56) References Cited

U.S. PATENT DOCUMENTS

| | | | | |
|---|---|---|---|---|
| 2010/0053105 | A1* | 3/2010 | Choi | G06F 3/04886 345/173 |
| 2010/0178028 | A1* | 7/2010 | Wahrhaftig | A63F 13/00 386/352 |
| 2011/0045907 | A1* | 2/2011 | Villa | A63F 13/00 463/37 |
| 2011/0134061 | A1* | 6/2011 | Lim | G06F 3/016 345/173 |
| 2011/0316793 | A1* | 12/2011 | Fushiki | G06F 3/04886 345/173 |
| 2012/0007884 | A1* | 1/2012 | Kim | G10H 1/24 345/633 |
| 2012/0057012 | A1* | 3/2012 | Sitrick | G09B 15/023 348/77 |
| 2012/0174736 | A1* | 7/2012 | Wang | G10H 1/0008 84/622 |
| 2012/0304847 | A1* | 12/2012 | Hacker | G09B 15/00 84/470 R |
| 2013/0133506 | A1* | 5/2013 | Daisy | G09B 5/06 84/455 |
| 2014/0000438 | A1* | 1/2014 | Feis | G10G 1/00 84/453 |
| 2014/0059471 | A1* | 2/2014 | Adam | G06F 3/04886 715/773 |

* cited by examiner

METHOD AND APPARATUS FOR SIMULATING A MUSICAL INSTRUMENT

CLAIM OF PRIORITY

This application claims the benefit under 35 U.S.C. §119 (a) of a Korean patent application filed in the Korean Intellectual Property Office on Aug. 6, 2014 and assigned Serial No. 10-2014-0101007, the entire disclosure of which is incorporated herein by reference.

TECHNICAL FIELD

The present disclosure relates to electronic devices, and more particularly to a method and apparatus for simulating a musical instrument.

BACKGROUND

Electronic devices such as a smartphone, a personal computer, and a tablet computer provide many useful functions to users through various applications. These electronic devices are being developed to additionally provide various types of information by various functions as well as a voice call function.

Aside from a simple voice call function and an Internet browsing function, users of electronic devices have recently demanded various entertainment functions.

As one of the entertainment functions, a function of displaying an element(s) (for example, a piano keyboard) of a user-intended musical instrument (for example, a piano) and allowing a user to play the musical instrument using the displayed element(s) is provided.

However, since the elements of the musical instrument are displayed in a very limited space such as a display of an electronic device, it might be difficult for the user has difficulty in playing the musical instrument using the displayed element(s). Accordingly, the need exists for new techniques for simulating musical instruments.

SUMMARY

The present disclosure addresses this need. According to one aspect of the disclosure, an apparatus is provided for simulating a musical instrument, comprising: a display configured to present a musical interface associated with an external image; a musical instrument setter configured to associate the musical interface with the musical instrument; and a sound area controller configured to arrange a portion of the musical interface as a sound area.

According to another aspect of the disclosure, a method is provided for simulating a musical instrument comprising: displaying, by an electronic device, a musical interface that is associated with an external image; associating the musical interface with the musical instrument; and arranging a portion of the musical interface as a sound area.

BRIEF DESCRIPTION OF THE DRAWINGS

The above and other aspects, features and advantages of certain exemplary embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
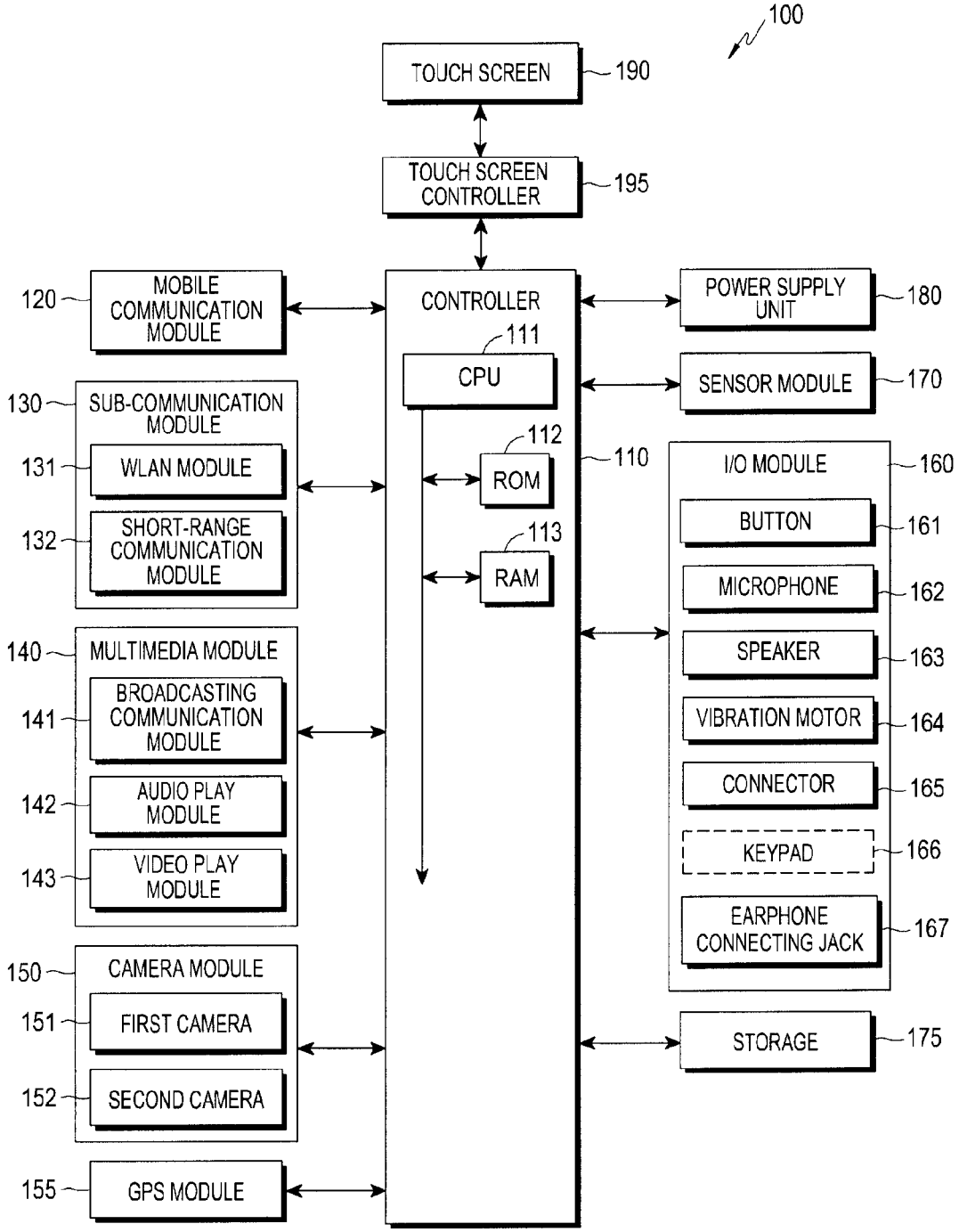
FIG. 1 is a block diagram of an example of an electronic device, according to aspects of the disclosure.

As the present disclosure allows for various changes and numerous embodiments, particular embodiments will be illustrated in the drawings and described in detail. However, the present disclosure is not limited to the specific embodiments and should be construed as including all the changes, equivalents, and substitutions included in the spirit and scope of the present disclosure.

Although ordinal numbers such as 'first', 'second', and so forth will be used to describe various components, those components are not limited by the terms. The terms are used only for distinguishing one component from another component. For example, a first component may be referred to as a second component and likewise, a second component may also be referred to as a first component, without departing from the teaching of the concept of the present disclosure. The term 'and/or' used herein includes any and all combinations of one or more of the associated listed items.

The terminology used herein is for the purpose of describing an embodiment only and is not intended to limit the present disclosure. As used herein, the singular forms are intended to include the plural forms as well, unless the context clearly indicates otherwise. It will be further understood that the terms 'comprises' and/or 'has' when used in this specification, specify the presence of stated feature, number, step, operation, component, element, or a combination thereof but do not preclude the presence or addition of one or more other features, numbers, steps, operations, components, elements, or combinations thereof.

An electronic device 100 according to an embodiment of the present disclosure may be a device with communication capabilities. For example, the electronic device 100 may be at least one of a smart phone, a tablet Personal Computer (PC), a mobile phone, a video phone, an e-Book reader, a desktop PC, a laptop PC, a Netbook computer, a Personal Digital Assistant (PDA), a Portable Multimedia Player (PMP), an MP3 player, a mobile medical equipment, a camera, and a wearable device (for example, a Head-Mounted Device (HMD) such as electronic glasses, electronic clothes, an electronic bracelet, an electronic necklace, an electronic Appcessory, an electronic tattoo, or a smart watch). While a smart phone is described herein as an embodiment of the electronic device 100 by way of example, for the convenience of description, it is clear to those skilled in the art that this does not limit the embodiment of the present disclosure.

Referring to FIG. 1, the electronic device 100 may be connected to an external device (not shown) through an external device connector such as a sub-communication module 130, a connector 165, and an earphone connector jack 167. The term 'external device' covers a variety of devices that can be detachably connected to the electronic device 100 by cable, such as an earphone, an external speaker, a Universal Serial Bus (USB) memory, a charger, a cradle, a docking station, a Digital Multimedia Broadcasting (DMB) antenna, a mobile payment device, a health care device (for example, a blood sugar meter and the like), a game console, a vehicle navigator, and the like. The 'external device' may also include a device wirelessly connectable to the electronic device 100 by short-range communication, such as a Bluetooth communication device, a Near Field Communication (NFC) device, a Wireless Fidelity (WiFi) Direct communication device, a wireless Access Point (AP), and the like. In addition, the external device may be any of another device, a portable phone, a smart phone, a tablet PC, a desktop PC, a server, and the like.

Referring to FIG. 1, the electronic device 100 includes a display 190 and a display controller 195. The electronic device 100 further includes a controller 110, a mobile communication module 120, the sub-communication module 130, a multimedia module 140, a camera module 150, a Global Positioning System (GPS) module 155, an Input/Output (I/O) module 160, a sensor module 170, a memory 175, and a power supply 180. The sub-communication module 130 includes at least one of a Wireless Local Area Network (WLAN) module 131 and a short-range communication module 132, and the multimedia module 140 includes at least one of a broadcasting communication module 141, an audio play module 142, and a video play module 143. The camera module 150 includes at least one of a first camera 151 and a second camera 152. The I/O module 160 includes at least one of buttons 161, a microphone 162, a speaker 163, a vibration motor 164, the connector 165, a keypad 166, and the earphone connector jack 167. The following description will be given with the appreciation that the display 190 and the display controller 195 are a touch screen and a touch screen controller, respectively, by way of example.

The controller 110 may include a Central Processing Unit (CPU) 111, a Read Only Memory (ROM) 112 for storing a control program to control the electronic device 100, and a Random Access Memory (RAM) 113 for storing signals or data received from the outside of the electronic device 100 or for use as a memory space for an operation performed by the electronic device 100. The CPU 111 may include any suitable type of processing circuitry, such as a general-purpose processor (e.g., an ARM-based processor), a Field-Programmable Gate Array (FPGA), an Application-Specific Integrated Circuitry (ASIC), a Digital Signal Processor (DSP), a Programmable Logic Device (PLD), etc. The CPU 111 may include one or more cores. The CPU 111, the ROM 112, and the RAM 113 may be interconnected through an internal bus.

The controller 110 may control the mobile communication module 120, the sub-communication module 130, the multimedia module 140, the camera module 150, the GPS module 157, the I/O module 160, the sensor module 170, the memory 175, the power supply 180, the touch screen 190, and the touch screen controller 195.

The mobile communication module 120 may connect the electronic device 100 to an external device through one or more antennas (not shown) by mobile communication under the control of the controller 110. The mobile communication module 120 transmits wireless signals to or receives wireless signals from a portable phone (not shown), a smart phone (not shown), a tablet PC (not shown), or another electronic device (not shown) that has a phone number input to the electronic device 100, for a voice call, a video call, a Short Message Service (SMS), or a Multimedia Messaging Service (MMS).

The sub-communication module 130 may include at least one of the WLAN module 131 and the short-range communication module 132. For example, the sub-communication module 130 may include either or both of the WLAN module 131 and the short-range communication module 132.

The WLAN module 131 may be connected to the Internet under the control of the controller 110 in a place where a wireless AP (not shown) is installed. The WLAN module 131 supports the WLAN standard IEEE802.11x of the Institute of Electrical and Electronics Engineers (IEEE). The short-range communication module 132 may conduct short-range wireless communication between the electronic device 100 and an image forming device (not shown) under the control of the controller 110. The short-range communication may conform to Bluetooth, Infrared Data Association (IrDA), WiFi Direct, Near Field Communication (NFC), and the like.

The electronic device 100 may include at least one of the mobile communication module 120, the WLAN module 131, and the short-range communication module 132 according to its capabilities. For example, the electronic device 100 may include a combination of the mobile communication module 120, the WLAN module 131, and the short-range communication module 132 according to its capabilities.

The multimedia module 140 may include the broadcasting communication module 141, the audio play module 142, or the video play module 143. The broadcasting communication module 141 may receive a broadcast signal (for example, a TV broadcast signal, a radio broadcast signal, or a data broadcast signal) and additional broadcasting information (for example, an Electronic Program Guide (EPG) or an Electronic Service Guide (ESG)) from a broadcasting station through a broadcasting communication antenna (not shown) under the control of the controller 110. The audio play module 142 may open a stored or received digital audio file (for example, a file having such an extension as mp3, wma, ogg, or wav) under the control of the controller 110. The video play module 143 may open a stored or received digital video file (for example, a file having such an extension as mpeg, mpg, mp4, avi, mov, or mkv) under the control of the controller 110. The video play module 143 may also open a digital audio file.

The multimedia module 140 may include the audio play module 142 and the video play module 143 without the broadcasting communication module 141. Or the audio play module 142 or the video play module 143 of the multimedia module 140 may be incorporated into the controller 110.

The camera module 150 may include at least one of the first camera 151 and the second camera 152, for capturing a still image or a video under the control of the controller 110. The first camera 151 or the second camera 152 may include an auxiliary light source for providing a light intensity required to capture an image. The first camera 151 may be disposed on the front surface of the electronic device 100, while the second camera 152 may be disposed on the rear surface of the electronic device 100. Or, the first camera 151 and the second camera 152 may be arranged near to each other in order to capture a three-dimensional still image or video.

The GPS module 155 may receive radio waves from a plurality of GPS satellites (not shown) in Earth orbit and determine a position of the electronic device 100 based on the Time of Arrivals (ToAs) of satellite signals from the GPS satellites to the electronic device 100.

The I/O module 160 may include at least one of the plurality of buttons 161, the microphone 162, the speaker 163, the vibration motor 164, the connector 165, and the keypad 166.

The buttons 161 may be formed on the front surface, a side surface, or the rear surface of a housing of the electronic device 100, and may include at least one of a power/lock button, a volume button, a menu button, a home button, a back button, a search button, and the like.

The microphone 162 receives a voice or a sound and converts the received voice or sound to an electrical signal under the control of the controller 110.

The speaker 163 may output sounds corresponding to various signals (for example, a wireless signal, a broadcast signal, a digital audio file, a digital video file, or a photo shot) received from the mobile communication module 120, the sub-communication module 130, the multimedia module 140, and the camera module 150 under the control of the controller 110. The speaker 163 may further output a sound corresponding to a function executed by the electronic device 100. One or more speakers 163 may be disposed at an appropriate position or positions of the housing of the electronic device 100.

The vibration motor 164 may convert an electrical signal to a mechanical vibration under the control of the controller 110. For example, when the electronic device 100 receives an incoming voice call from another device (not shown) in vibration mode, the vibration motor 164 operates. One or more vibration motors 164 may be mounted inside the housing of the electronic device 100. The vibration motor 164 may operate in response to a user's touch on the touch screen 190 and a continuous movement of the touch on the touch screen 190.

The connector 165 may be used as an interface for connecting the electronic device 100 to an external device (not shown) or a power source (not shown). The electronic device 100 may transmit data stored in the memory 175 to an external device (not shown) via a cable connected to the connector 165 or may receive data from the external device via the cable, under the control of the controller 110. The external device may be a docking station and the data may be an input signal from an external input device such as a mouse, a keyboard, and the like. The electronic device 100 may receive power from a power source (not shown) via a cable connected to the connector 165 or may charge a battery (not shown) using the power source.

The keypad 166 may receive a key input from a user to control the electronic device 100. The keypad 166 includes a physical keypad (not shown) formed in the electronic device 100 or a virtual keypad (not shown) displayed on the touch screen 190. The physical keypad may not be provided according to the capabilities or configuration of the electronic device 100.

An earphone (not shown) may be connected to the electronic device 100 by being inserted into the earphone connector jack 167.

The sensor module 170 includes at least one sensor for detecting a state of the electronic device 100. For example, the sensor module 170 may include a proximity sensor for detecting whether a user is close to the electronic device 100 and an illumination sensor (not shown) for detecting the amount of ambient light around the electronic device 100. In addition, the sensor module 170 may include a gyro sensor. The gyro sensor may detect a motion of the electronic device 100 (for example, a rotation of the electronic device 100 or an acceleration or vibration applied to the electronic device 100), detect a point of the compass using the earth's magnetic field, and detect the direction of gravity. The sensor module 170 may also include an altimeter for detecting an altitude by measuring air pressure. At least one sensor may detect a state of the electronic device 100, generate a signal corresponding to the detected state, and transmit the generated signal to the controller 110. A sensor may be added to or removed from the sensor module 170 according to the capabilities of the electronic device 100.

The memory 175 may store input/output signals or data in accordance with operations of the mobile communication module 120, the sub-communication module 130, the multimedia module 140, the camera module 150, the GPS module 155, the I/O module 160, the sensor module 170, and the touch screen 190 under the control of the controller 110. The memory 175 may store a control program for controlling the electronic device 100 or the controller 110, and applications.

The term "memory" may include the memory 175, the ROM 112 and the RAM 113 within the controller 110, or a memory card (not shown) (for example, a Secure Digital (SD) card, a memory stick, and the like) mounted to the electronic device 100. The memory may include a non-volatile memory, a volatile memory, a Hard Disk Drive (HDD), a Solid State Drive (SSD), and the like.

The power supply 180 may supply power to one or more batteries (not shown) mounted in the housing of the electronic device 100 under the control of the controller 110. The one or more batteries supply power to the electronic device 100. The power supply 180 may supply power received from an external power source (not shown) via a cable connected to the connector 165 to the electronic device 100. Further, the power supply 180 may supply power received from an external power source wirelessly to the electronic device 100 by a wireless charging technology.

The touch screen 190 may provide User Interfaces (UIs) corresponding to various services (for example, call, data transmission, broadcasting, photo taking, and the like) to the user. The touch screen 190 may transmit an analog signal corresponding to at least one touch on a UI to the touch screen controller 195. The touch screen 190 may receive at least one touch input through a user's body part (for example, a finger such as a thumb) or a touch input means (for example, a stylus pen). The touch screen 190 may receive a continuous movement of a single touch, among one or more touches. The touch screen 190 may transmit an analog signal corresponding to a continuous movement of a touch to the touch screen controller 195.

In the present disclosure, the touch may include a non-contact touch, not limited to contacts between the touch screen 190 and the user's body part or the touch input means. A gap detectable to the touch screen 190 may vary according to the capabilities or configuration of the electronic device 100.

The touch screen 190 may be implemented as, for example, a resistive type, a capacitive type, an infrared type, or an acoustic wave type.

The touch screen controller 195 converts an analog signal received from the touch screen 190 to a digital signal (X and Y coordinates) and transmits the digital signal to the controller 110. The controller 110 may control the touch screen 190 using the received digital signal. For example, the controller 110 may select or execute a shortcut icon (not shown) displayed on the touch screen 190 in response to a touch. The touch screen controller 195 may be incorporated into the controller 110.

Figure 2:
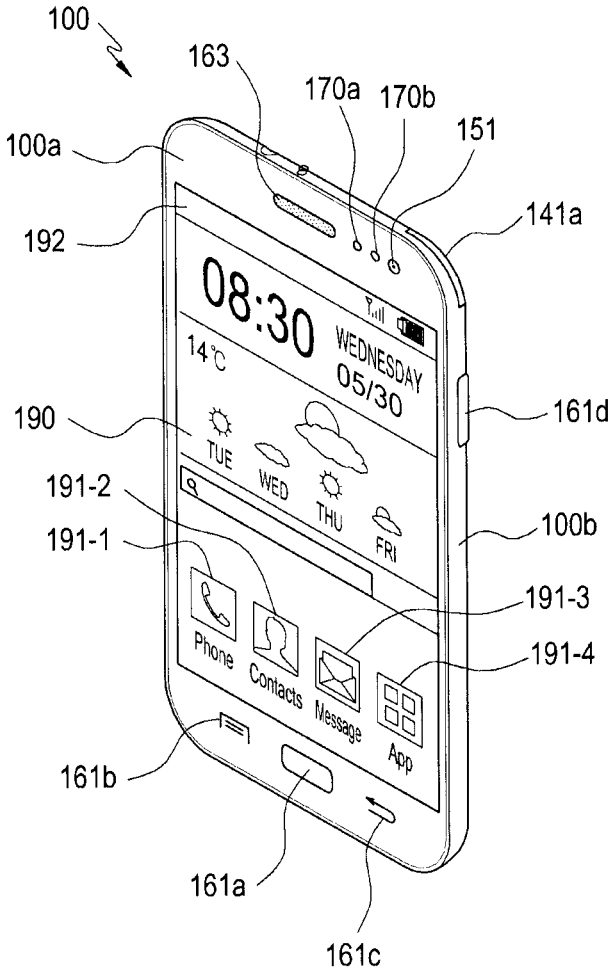
FIG. 2 is a front perspective view of the electronic device, according to aspects of the disclosure.
Figure 3:
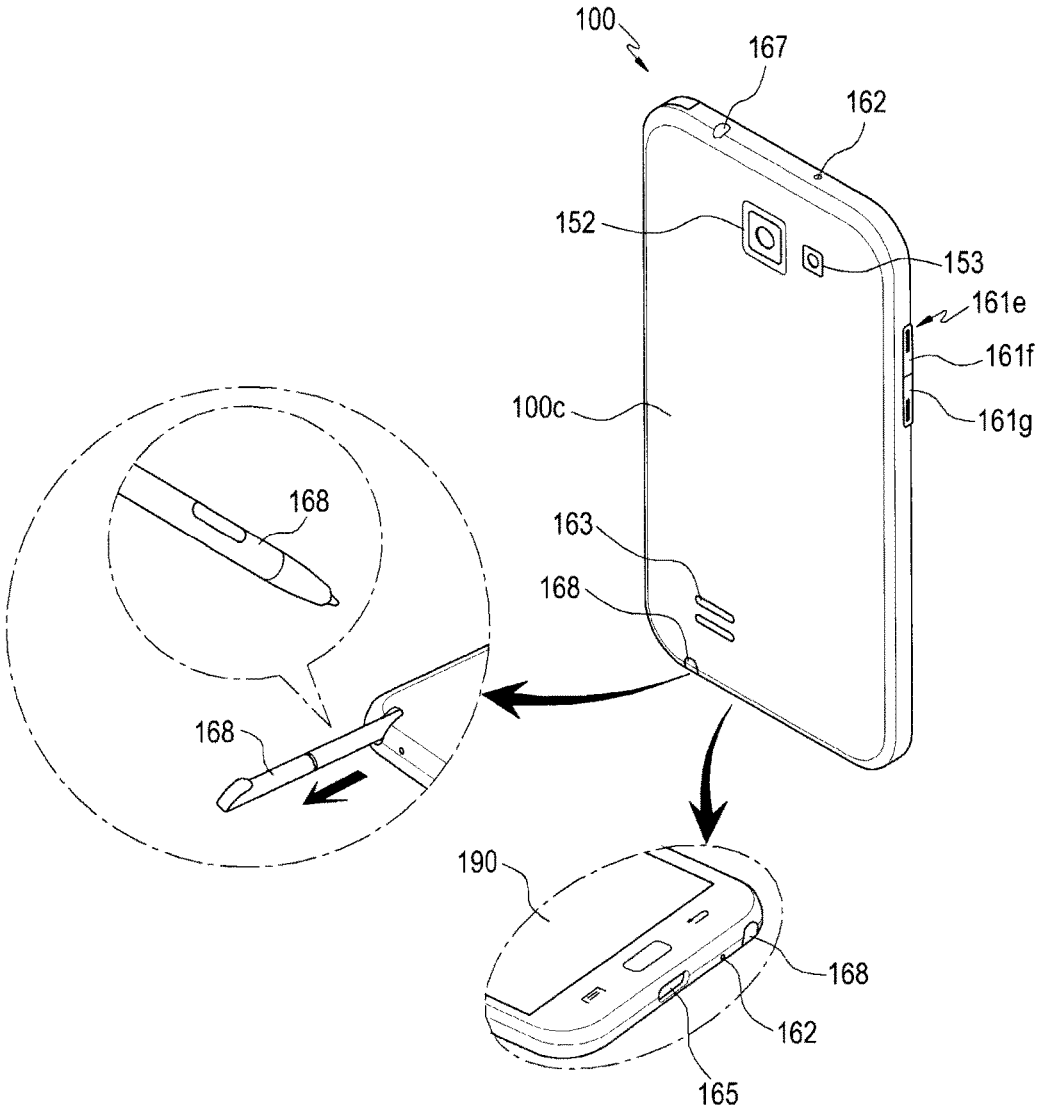
FIG. 3 is a rear perspective view of the electronic device, according to aspects of the disclosure.

FIGS. 2 and 3 are front and rear perspective views of the electronic device respectively according to the embodiment of the present disclosure.

Referring to FIG. 2, the touch screen 190 is disposed at the center of the front surface 100*a* of the electronic device 100, occupying almost the entirety of the front surface 100*a*. In FIG. 2, a main home screen is displayed on the touch screen 190, by way of example. The main home screen is the first screen to be displayed on the touch screen 190, when the electronic device 100 is powered on. In the case where the electronic device 100 has different home screens of a plurality of pages, the main home screen may be the first of the home screens of the plurality of pages. Shortcut icons 191-1, 191-2 and 191-3 for executing frequently used applications, an application switch key 191-4, time, weather, and the like may be displayed on the home screen. The application switch key 191-4 displays application icons representing applications on the touch screen 190. A status bar 192 may be displayed at the top of the touch screen 190 in order to indicate states of the electronic device 100 such as a battery charged state, a received signal strength, and a current time.

A home button 161*a*, a menu button 161*b*, and a back button 161*c* may be formed at the bottom of the touch screen 190.

The home button 161*a* is used to display the main home screen on the touch screen 190. For example, upon touching of the home button 161*a* while any home screen other than the main home screen or a menu screen is displayed on the touch screen 190, the main home screen may be displayed on the touch screen 190. Upon pressing (touching) of the home button 161*a* during execution of applications on the touch screen 190, the main home screen illustrated in FIG. 2 may be displayed on the touch screen 190. The home button 161*a* may also be used to display recently used applications or a task manager on the touch screen 190.

The menu button 161*b* provides link menus available on the touch screen 190. The link menus may include a widget adding menu, a background changing menu, a search menu, an edit menu, an environment setting menu, and the like. When an application is executed, a link menu linked to the application may be provided.

The back button 161*c* may display a screen previous to a current screen or end the latest used application.

The first camera 151, an illumination sensor 170*a*, and a proximity sensor 170*b* may be arranged at a corner of the front surface 100*a* of the electronic device 100, whereas the second camera 152, a flash 153, and the speaker 163 may be arranged on the rear surface 100*c* of the electronic device 100.

For example, a power/reset button 161*d*, a volume button 161*e*, a terrestrial Digital Multimedia Broadcasting (DMB) antenna 141*a* for receiving a broadcast signal, and one or more microphones 162 may be disposed on side surfaces 100*b* of the electronic device 100. The DMB antenna 141*a* may be mounted to the electronic device 100 fixedly or detachably.

The connector 165 is formed on the bottom side surface of the electronic device 100. The connector 165 includes a plurality of electrodes and may be connected to an external device by wire. The earphone connector jack 167 may be formed on the top side surface of the electronic device 100, for allowing an earphone to be inserted.

Figure 4:
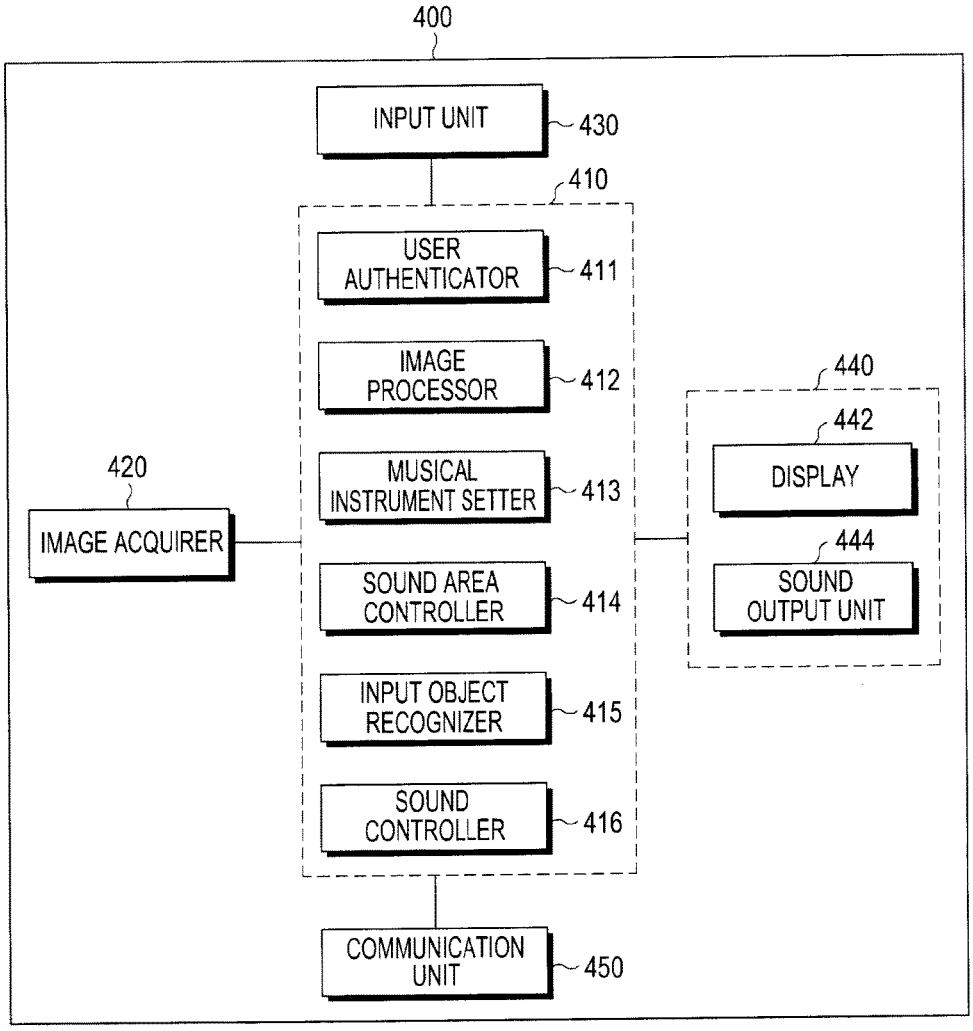
FIG. 4 is a block diagram of an example of an apparatus for simulating a musical instrument, according to aspects of the disclosure.

FIG. 4 is a block diagram of an apparatus for controlling play of a musical instrument according to an embodiment of the present disclosure.

Referring to FIG. 4, an apparatus 400 for simulating a musical instrument according to an embodiment of the present disclosure may include a controller 410, an image acquirer 420, an input unit 430, an output unit 440, and a communication unit 450. The controller 410 may include a user authenticator 411, an image processor 412, a musical instrument setter 413, a sound area controller 414, an input object recognizer 415, and a sound controller 416. The output unit 440 may include a display 442 and a sound output unit 444. The modules 411-416, may be implemented in any suitable fashion. For example one or more of the modules 411-416 may be implemented in software (e.g., as processor-executable instructions that are executed by processing circuitry), in hardware, or as a combination of software and hardware. Although in this example the modules 411-416 are depicted as discrete elements, in some embodiments two or more of the modules 411-416 can be integrated together.

Figure 5A:
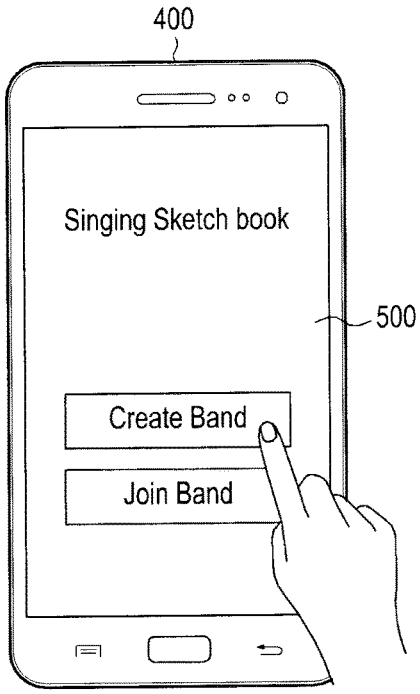
FIG. 5A is a diagram of an example of a user interface for creating and/or joining a music band, according to aspects of the disclosure.
Figure 5B:
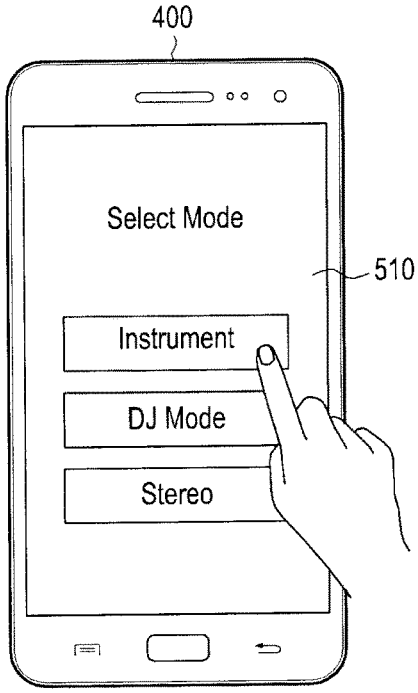
FIG. 5B is a diagram of an example of a user interface for mode selection, according to aspects of the disclosure.
Figure 6:
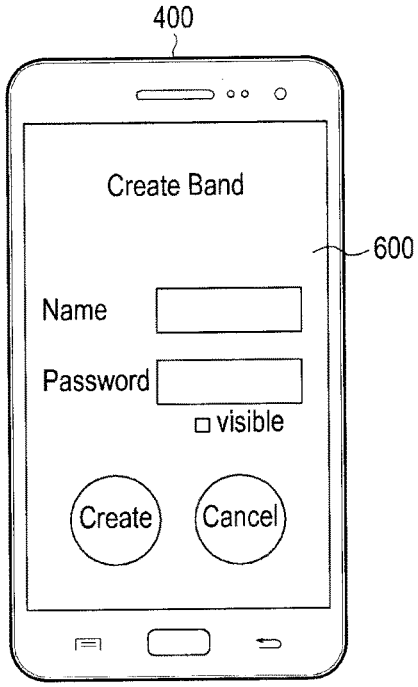
FIG. 6 is a diagram of an example of a user interface for user authentication, according to aspects of the disclosure.

The user authenticator 411 may authenticate a user by receiving user authentication information from the user. The user authentication information may include, for example, an Identifier (ID) and a password which are preset by the user. FIGS. 5A, 5B, and 6 are diagrams illustrating an embodiment of screens displayed for play mode entry and user authentication, when the apparatus 400 according to the embodiment of the present disclosure is implemented in the electronic device 100. In FIGS. 5A, 5B, and 6, the apparatus 400 according to the embodiment of the present disclosure is implemented and operates in the form of an application executable in the electronic device 100, by way of example.

Referring to FIGS. 5A, 5B, and 6, a user may execute an application. Upon execution of the application, the display 442 may display an initial screen 500 of the application. A function(s) or operation(s) of the display 442 may be executed preferably by the touch screen 190 according to an embodiment of the present invention.

The user may select a "Create Band" icon on the initial screen 500 to play a musical instrument using the apparatus 400 according to the embodiment of the present disclosure. Upon user selection of the "Create Band" icon, the display 442 may display icons for selecting various modes related to "Create Band", as illustrated in FIG. 5B. The user may select, for example, an "Instrument" mode and may execute various settings related to music performance. A "DJ Mode" and a "Stereo" mode will be described later.

Figure 7:
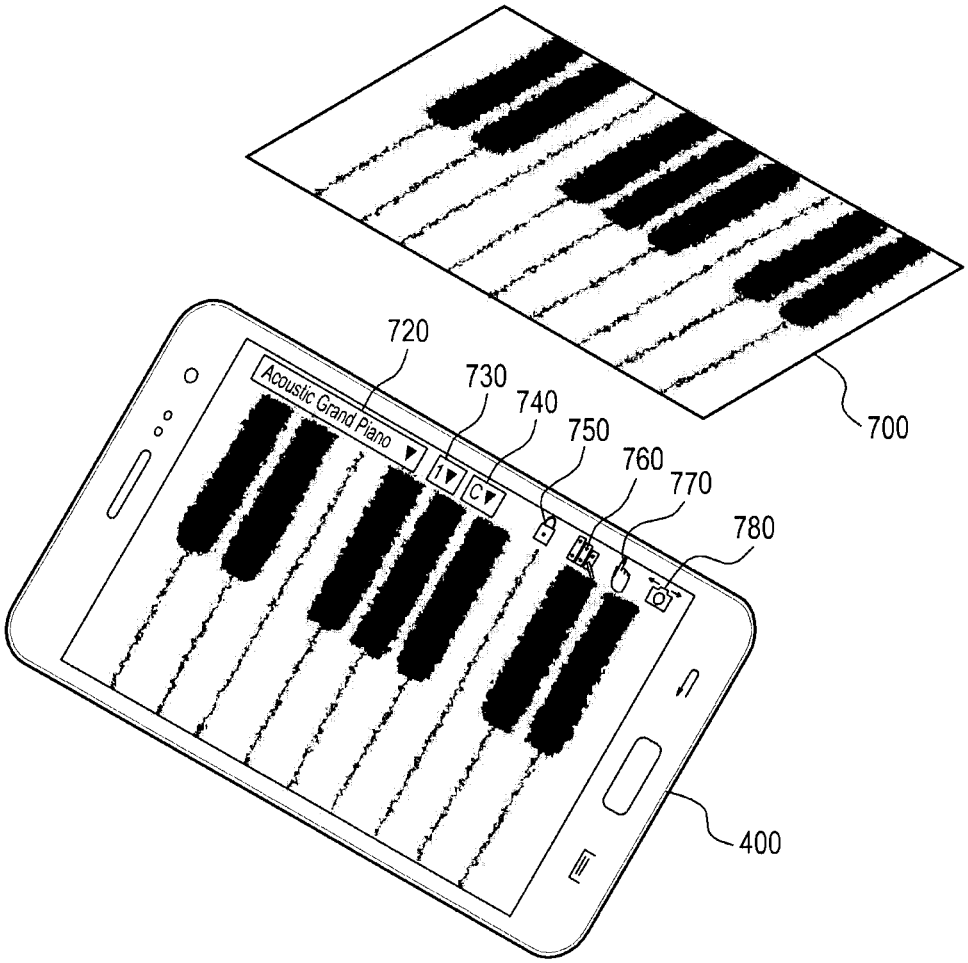
FIG. 7 is a diagram of an example of an external drawing of a musical interface and a screen that includes the musical.

Upon user selection of the "Instrument" mode, the display 442 may optionally display a user authentication screen 600 as illustrated in FIG. 6. The apparatus 400 may authenticate the user by user authentication information (for example, the user's name and password) input to the user authentication screen 600 by the user. If the received user authentication information matches user-preset authentication information, the user authenticator 411 may authenticate the user as authorized. If the user is authenticated as authorized and a request for entering a play mode (for example, by selecting a "Create" icon) is received from the user, the user authenticator 411 may display a screen for the play mode, as illustrated in FIG. 7.

The image acquirer 420 may acquire one or more photographs of an external image 700. A function(s) or operation (s) of the image acquirer 420 may be executed preferably by the camera module 150 according to an embodiment of the present disclosure. The image acquirer 420 may acquire the external image 700 and the controller 410 may control display of the music interface depicted in the external image 700 on the display 442, as illustrated in FIG. 7. The external image 700 may not be connected to the electronic device 100 through an electronic medium or device. The external image 700 may preferably be an image drawn/presented on a sheet of paper and/or another medium. While in the present example the external image 700 depicts a piano interface, it will be readily appreciated that any suitable type of musical interface may be depicted by the external image 700, such as a percussion interface, a xylophone interface, etc.

The controller 410 may control display of various UIs along with the musical interface depicted in the external image 700. For example, the controller 410 may control display of an instrument selection menu 720. The user may select an available musical instrument by the instrument selection menu 720. Further, the controller 410 may control display of an octave selection menu 730 and a scale selection menu 740. The controller 410 may control display of a lock icon 750, an instrument display icon 760, a sound area setting icon 770, and a camera reversal icon 780.

If the user selects the lock icon 750, the controller 410 may disable a selected function/functions or operation/operations even though the user selects the home button 161*a*, the menu button 161*b*, and the back button 161*c*. The user may prevent execution of an unintended function(s) or operation(s) during manipulation of the electronic device 100 for music performance by selecting the lock icon 750 and thus activating lock setting.

Figure 8A:
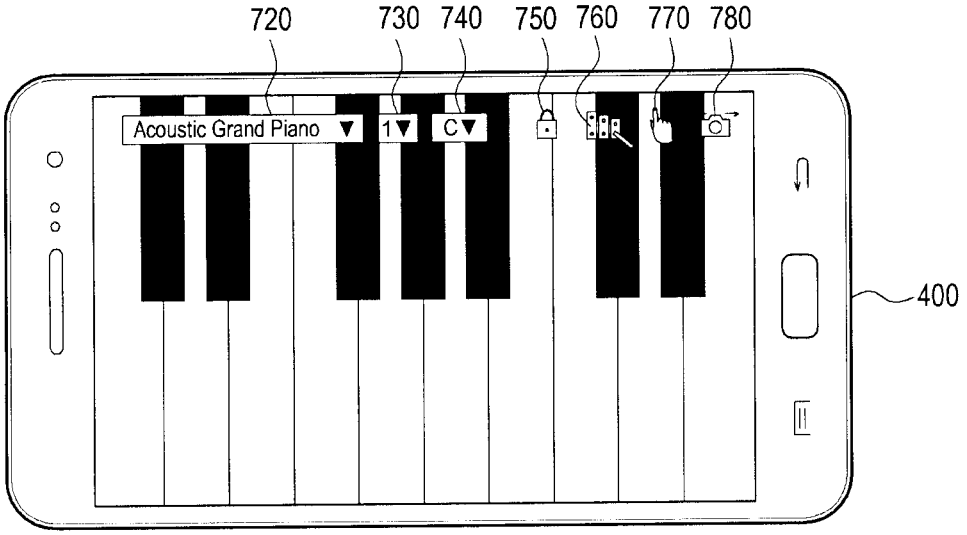
FIG. 8A is a diagram of an example of a user interface, according to aspects of the present disclosure.
Figure 8B:
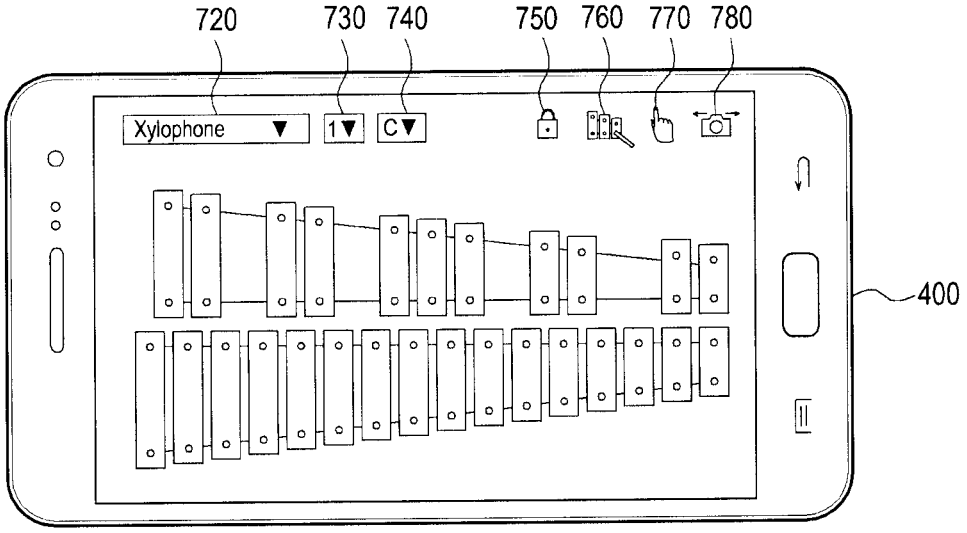
FIG. 8B is a diagram of an example of a user interface, according to aspects of the present disclosure.
Figure 8C:
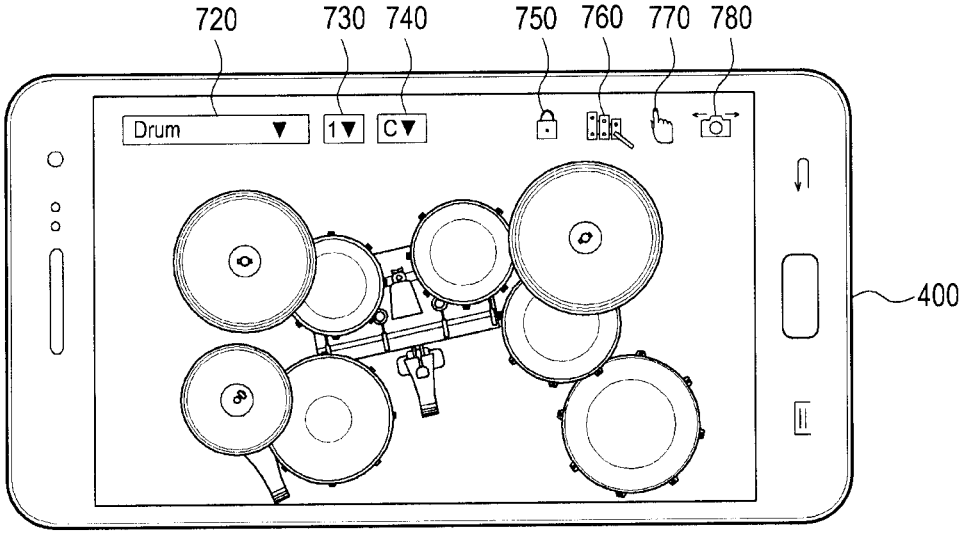
FIG. 8C is a diagram of an example of a user interface, according to aspects of the present disclosure.

When the user requests display of a musical instrument by selecting the instrument display icon 760, the controller 410 may control display of a musical instrument matching an instrument type selected through the instrument selection menu 720 by the user. According to an embodiment of the present disclosure, the musical instrument setter 413 may determine an instrument type to be played according to the user's instrument selection request through the instrument selection menu 720 and display a musical instrument matching the user-selected instrument type. FIGS. 8A, 8B, and 8C illustrate screens displaying various types of musical instruments.

If the user sets a musical instrument to be played to "Acoustic Grand Piano" by the instrument selection menu 720 and selects the instrument display icon 760, the musical instrument setter 413 may control display of an image of an acoustic grand piano, as illustrated in FIG. 8A. Likewise, if the user selects xylophone, the musical instrument setter 413 may control display of an image of a xylophone as illustrated in FIG. 8B. If the user selects drum, the musical instrument setter 413 may control display of an image of a drum, as illustrated in FIG. 8C. The musical instruments illustrated in FIGS. 8A, 8B, and 8C are presented for illustrative purposes to describe the present disclosure. Available musical instruments according to an embodiment of the present disclosure may include many other musical instruments than piano, xylophone, and drum.

Musical instruments available for performance may be preset or the user may purchase such musical instruments by accessing a selling server (not shown) by wireless or wired communication. In the latter case, the user may pay for a musical instrument by electronic payment. The wireless communication may conform to, for example, at least one of WiFi, BT, NFC, GPS, and cellular communication (for example, Long Term Evolution (LTE), LTE-Advanced (LTE-A), Code Division Multiple Access (CDMA), Wideband CDMA (WCDMA), Universal Mobile Telecommunication System (UMTS), Wireless Broadband (WiBro), or Global System for Mobile communication (GSM)). The wired communication may conform to, for example, at least one of USB, High Definition Multimedia Interface (HDMI), Recommended Standard 232 (RS 232), and Plain Old Telephone Service (POTS).

Upon photographing the external image 700, the image processor 412 may generate a differential image for the external image 700. To generate the differential image, the image processor 412 may determine a reference image (hereinafter "first image"). For example, an image obtained a predetermined time (for example, 0.5 second) after a time when the image acquirer 420 acquires the external image 700 for the first time may be set as the reference image for differential image generation. Further, the user may reset the reference image by selecting an image reset icon 1320 illustrated in FIG. 13. In embodiments of resetting a reference image by selecting the image reset icon 1320, the user may change an angle of the apparatus 400 during music performance or may replace the external image 700 with another one (not shown), for music performance with the changed external image.

After the reference image is set, the image processor 412 may generate the differential image by comparing the reference image with photographs (hereinafter "second image") of the external image 700 continuously acquired from the image acquirer 420.

The image processor 412 may generate the differential image by comparing the reference image with the image of the external image 700 only in terms of chrominance Cb and Cr except luminance Y among the Y, Cb, and Cr data. Therefore, it is preferred that the external image 700 is monochrome (for example, white, gray, and black) according to an embodiment of the present disclosure. For example, it is preferred that paper serving as the background of the external image 700 is white, a figure(s) drawn on the paper is black, and an input object (for example, a drum stick) is monochrome.

As described before, the display 442 may display an external image 700 and a UI(s) related to a music performance. According to an embodiment of the present disclosure, a function(s) or operation(s) of the display 442 may be executed by the touch screen 190. If the display 442 is implemented by the touch screen 190, a function(s) or operation(s) executed by the input unit 430 may be implemented by the touch screen 190 according to an embodiment of the present disclosure. The description of the touch screen 190 is applied to the display 442 and thus the display 442 will not be described in detail herein.

The musical instrument setter 413 may determine an instrument type to be played according to a user's instrument selection request through the afore-described instrument selection menu 720 and may display a musical instrument matching the user-selected instrument type according to an instrument display request.

Figure 9:
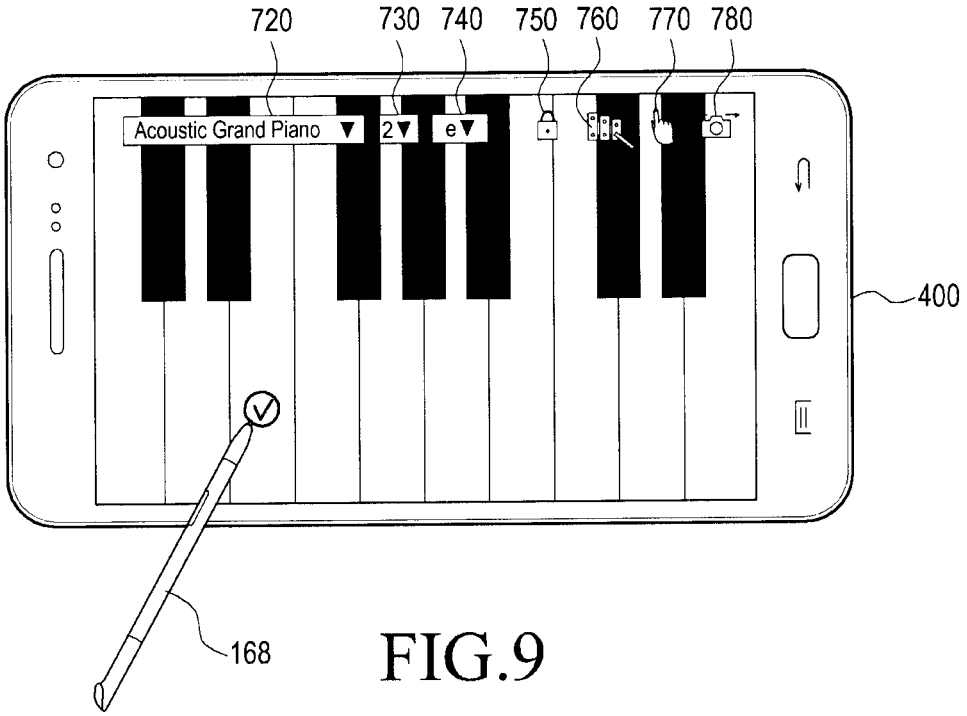
FIG. 9 is a diagram of an example of a user interface for arranging a portion of a musical interface as a sound area, according to aspects of the present disclosure.
Figure 10:
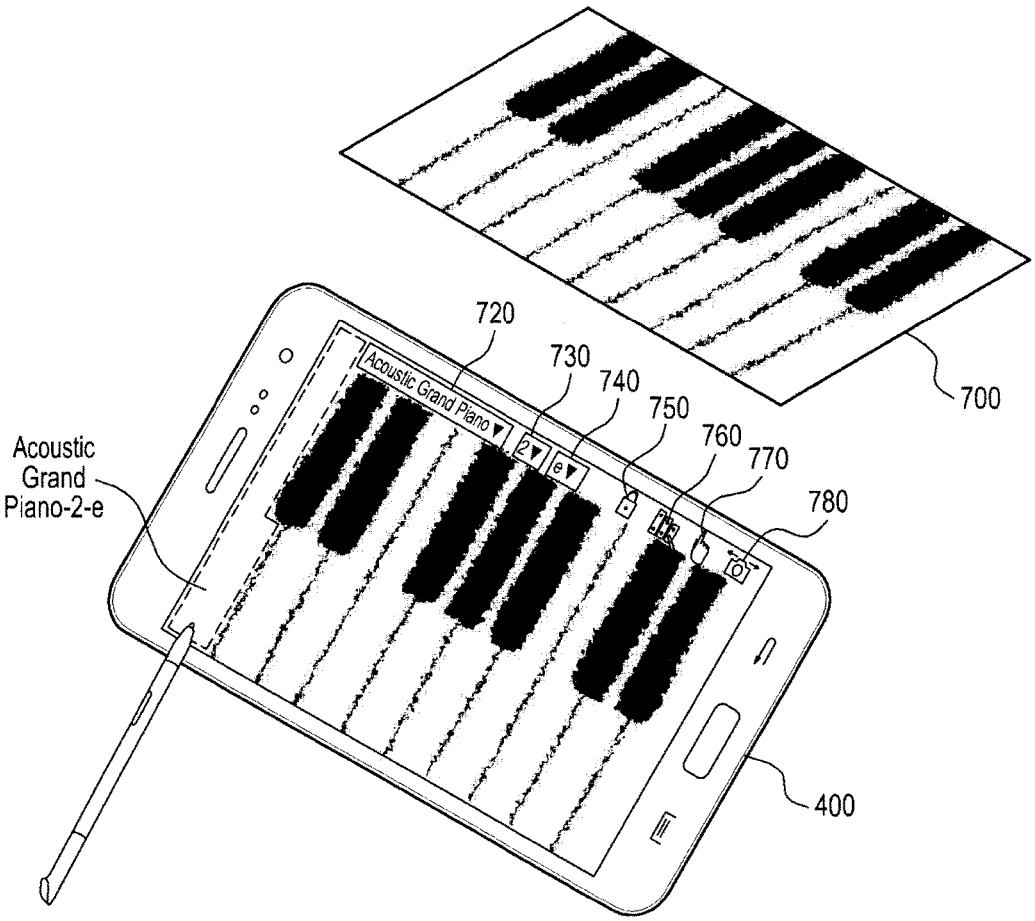
FIG. 10 is a diagram of an example of a user interface for arranging a portion of a musical interface as a sound area, according to aspects of the present disclosure.

The sound area controller 414 may set at least one sound area 1000 that outputs a sound corresponding to the musical instrument selected by the user. The sound area 1000 may refer to an area that outputs a sound corresponding to each element of the musical instrument selected by the user. That is, if an input object 1100 is placed at a position of on the external image 700 corresponding to the sound area 1000, a sound corresponding to an element set for the sound area 1000 may be output. FIGS. 9 and 10 illustrate an operation for setting a sound area 1000. FIG. 9 is a diagram illustrating an operation for setting an element of a musical instrument in correspondence with a sound area according to an embodiment of the present disclosure, and FIG. 10 is a diagram illustrating an operation for setting a sound area according to an embodiment of the present disclosure.

Referring to FIG. 9, the user may select a musical instrument (for example, an acoustic grand piano) and then select the instrument display icon 760 in order to set a sound area. As illustrated in FIG. 9, if an image of the musical instrument is displayed on the display 442, the user may select one of elements (for example, piano keys) included in the musical instrument, corresponding to sound areas. While the user is selecting the element, an octave and a scale of the musical instrument may be adjusted. The sound controller 416 may adjust an octave and scale of the musical instrument according to an embodiment of the present disclosure. If the sound controller 416 sets all octaves and scales for the musical instrument upon user request and then the user selects an intended element of the musical instrument, the sound output unit 444 may temporarily output a sound corresponding to the selected element. In this manner, the user may confirm whether the musical instrument outputs sounds correctly.

Referring to FIG. 10, the sound area controller 414 may set a sound area according to a user's request for setting a sound area through an input means (for example, a stylus pen 168). The user may request sound area setting by dragging the input means 168, as illustrated in FIG. 10. However, the setting of the sound area 1000 by means of a stylus pen as illustrated in FIG. 10 is a mere embodiment of the present disclosure. The user may input a request for setting the sound area 1000 by various input objects (for example, a user's finger). After setting the sound area 1000 according to the user's request, the sound area controller 414 may store sound data of the user-requested element of the musical instrument by mapping sound data to the sound area. If there is a plurality of sound areas 1000, different sounds may be mapped to the respective sound areas 1000 according to a user's request. In some embodiments, the same sound may be mapped to the sound areas 1000 upon user request.

Once the sound area 1000 is set, the type, octave, and scale of the musical instrument may be displayed in the sound area 1000 as illustrated in FIG. 10. In some embodiments, a type, octave, and scale of a musical instrument may not be displayed in the sound area 1000.

Figure 11:
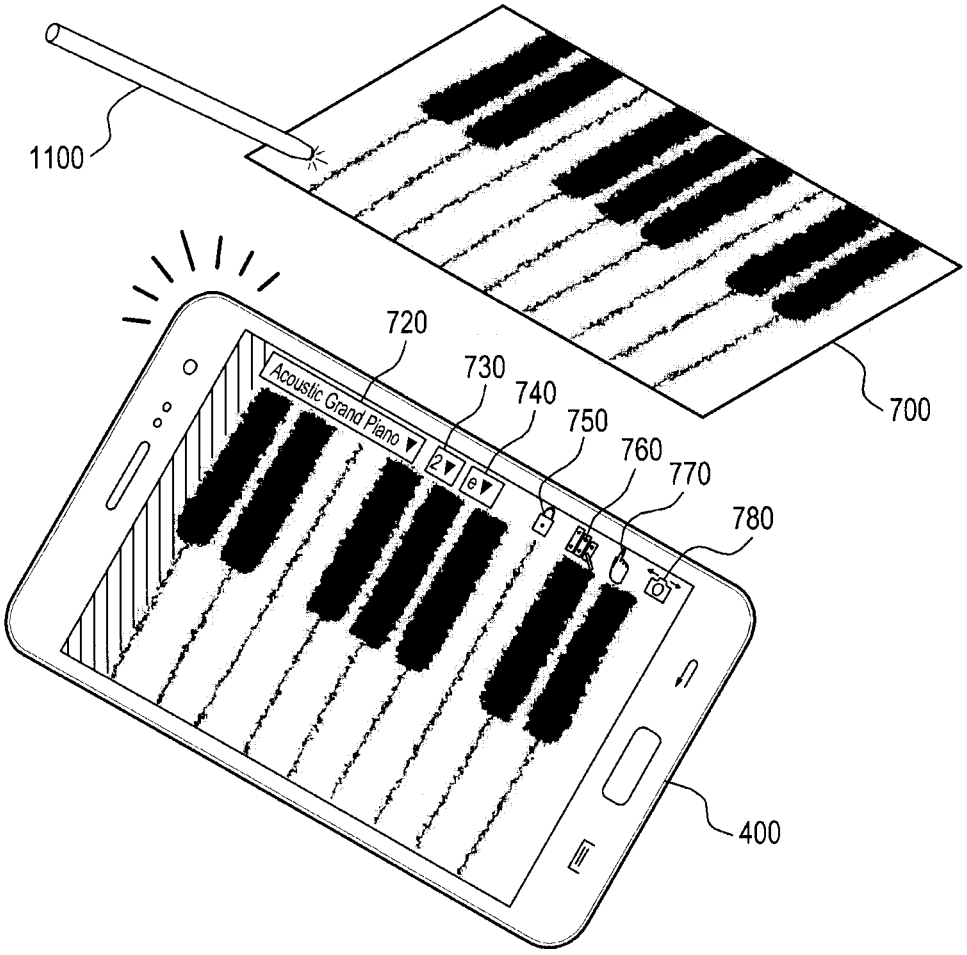
FIG. 11 is a diagram illustrating the operation of a simulated musical instrument, according to aspects of the present disclosure.

The input object recognizer 415 may recognize an input object based on a differential image generated by the image processor 412. According to an embodiment of the present disclosure, since the image processor 412 generates the differential image based on a chrominance value as described before, the input object may be colored. In some embodiments, the input object may include a Light Emitting Diode (LED) as illustrated in FIG. 11. To achieve an object of the present disclosure, the LED is preferably illuminated in a color (for example, red). FIG. 11 illustrates an operation for recognizing an input object. FIG. 11 is a diagram illustrating an operation for outputting a sound which has been set, when the input object 1100 is positioned in the sound area 1000 according to an embodiment of the present disclosure.

The user may play music by using an input object to make contact with various figures or shapes depicted in the external image 700. According to aspects of the disclosure, the user may make contact with the figures or shapes depicted in the external image by physically touching the figures or shapes with the input object. For example, the user may play music by tapping on the figures or shapes in the external image 700. Additionally or alternatively, the user may make contact with the various figures or shapes depicted in the external image 700 by shining a light on the figures or shapes with the input object. For example, as illustrated in FIG. 11, the input object 1100 is a drum stick having an LED, by way of example. The input object recognizer 415 may determine a position of the LED from a differential image. If the position corresponds to the sound area 1000, the sound controller 416 may control the output of a stored sound mapped to the sound area 1000 through the sound output unit 444.

The input object 1100 illustrated in FIG. 11, that is, a drum stick with an LED is exemplary. In some embodiments, the user may play a musical instrument with a finger. Even when the user uses the user's finger as an input object, the image processor 412 may also extract a different image from a chrominance value and thus the input object recognizer 415 may recognize the user's finger as an input object. If a piano is set as a musical instrument to be played, the user's finger is preferable as the input object 1100 according to an embodiment of the present disclosure. That is, the input object 1100 may include an LED or may be colored to allow accurate detection of the input object 1100 according to the embodiment of the present disclosure. If the input object 1100 is positioned at a location in the external image 700 corresponding to the sound area 1000, a visual effect, for example, coloring of the sound area 1000 may be produced.

The sound controller 416 may execute a function(s) or operation(s) including a change in sound property such as an octave and/or scale of a musical instrument and sound output control according to a user's request.

The sound output unit 444 may execute a function(s) or operation(s) for outputting sounds of various musical instruments, as described before. The function(s) or operation(s) of the sound output unit 444 may be performed by, for example, the speaker 163 according to an embodiment of the present disclosure.

Because the function(s) or operation(s) of the sound controller 416 and the sound output unit 444 have been described before, their detailed description will not be provided herein.

The input unit 430 may receive various types of information input by the user, for music performance according to an embodiment of the present disclosure. A function(s) or operation(s) of the input unit 430 may be performed by the touch screen 190, as described before. Further, a function(s) or operation(s) of the input unit 430 may be performed by, for example, the afore-described buttons 161 or the keypad 166.

The communication unit 450 may execute a function/functions or operation(s) for transmitting various types of information between the apparatus 400 according to the embodiment of the present disclosure and another electronic device (for example, a server or another apparatus) connected to the apparatus 400 wirelessly or via a wired connection. The function(s) or operation(s) of the communication unit 450 may be performed by, for example, the sub-communication module 130.

Figure 12:
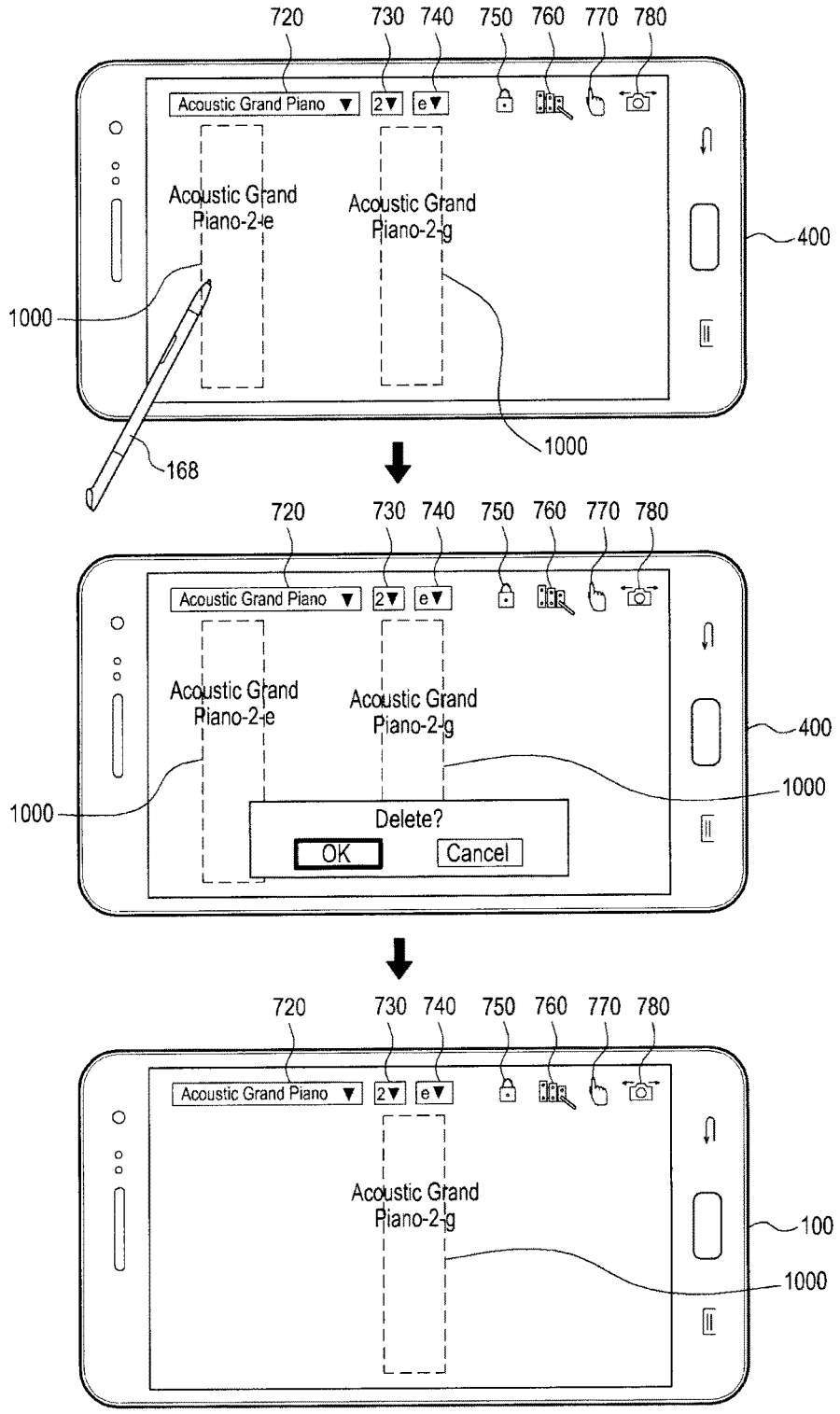
FIG. 12 is a diagram of an example of a user interface for deleting a specified sound area, according to aspects of the disclosure.

FIG. 12 is a diagram of an example of a user interface for deleting a specified sound area, according to aspects of the disclosure.

Referring to FIG. 12, the user may apply, for example, a long touch gesture to a sound area 1000 to be deleted. Upon receipt of the long touch input on the sound area 1000, the sound area controller 414 may control display of a delete confirm message. Upon receipt of a confirm request (for example, by selecting an OK icon) from the user, the sound area controller 414 may delete the sound area 1000 to which the long touch gesture has been applied. The deletion of the sound area 1000 may include the deletion of data of pixel coordinates of the sound area 1000 to be deleted and sound data mapped to the sound area 1000.

Figure 13:
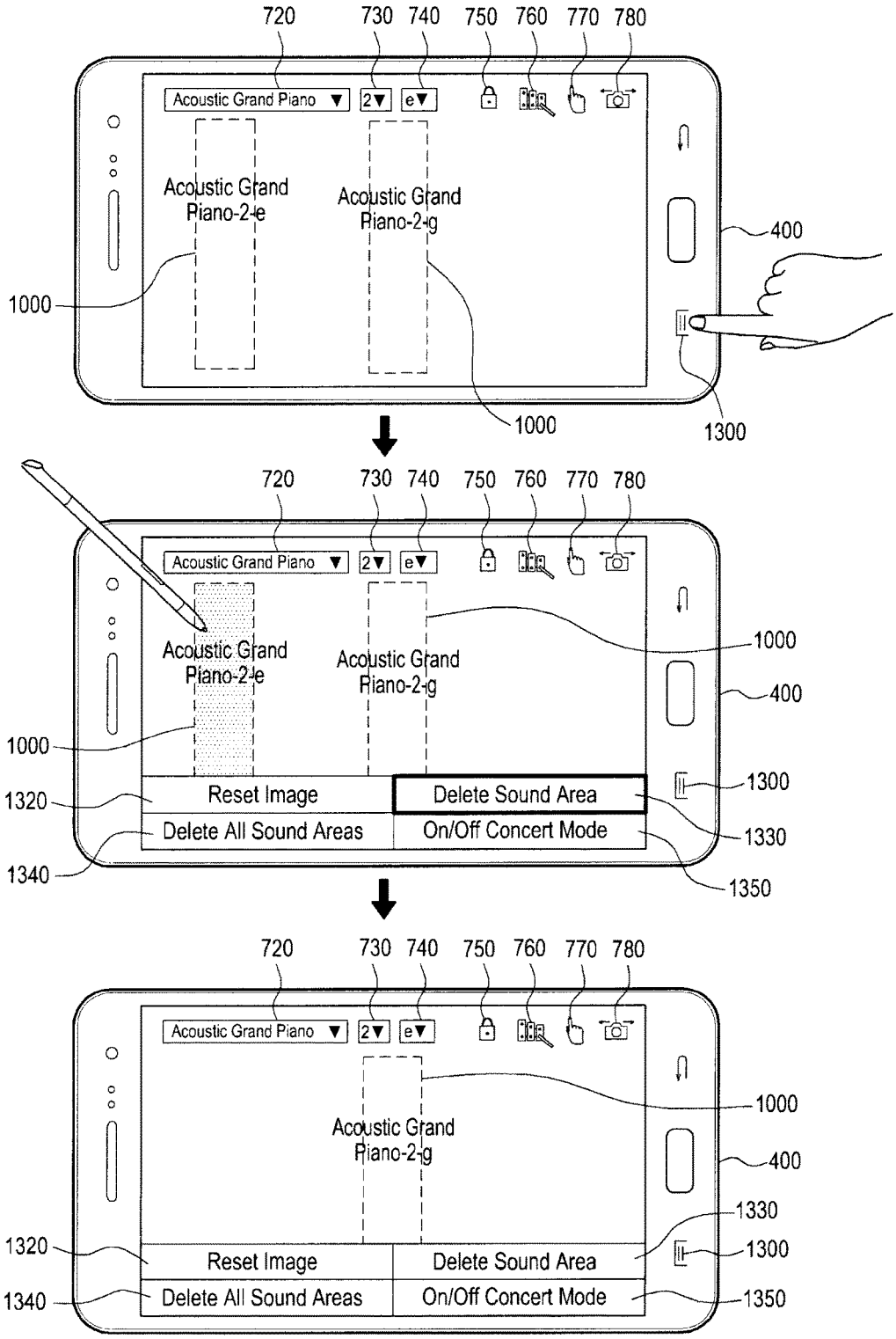
FIG. 13 is a diagram of an example of a user interface for deleting a specified sound area, according to aspects of the disclosure.

FIG. 13 is a diagram of an example of a user interface for deleting a sound area according to another embodiment of the present disclosure.

Referring to FIG. 13, the user may select a menu button 1300 in the apparatus 400. Upon receipt of a menu display request from the user, the display 442 may display user menus 1320, 1330, 1340, and 1350. The user may select a sound area 1000 to be deleted and then select the sound area delete menu 1330 from among the displayed user menus 1320, 1330, 1340, and 1350. Upon receipt of the request for deleting the sound area 1000 from the user, the sound area controller 414 may delete the selected sound area 1000. According to an embodiment of the present disclosure, the user may delete all of preset sound area(s) 1000 by selecting the all sound area delete menu 1340.

Figure 14:
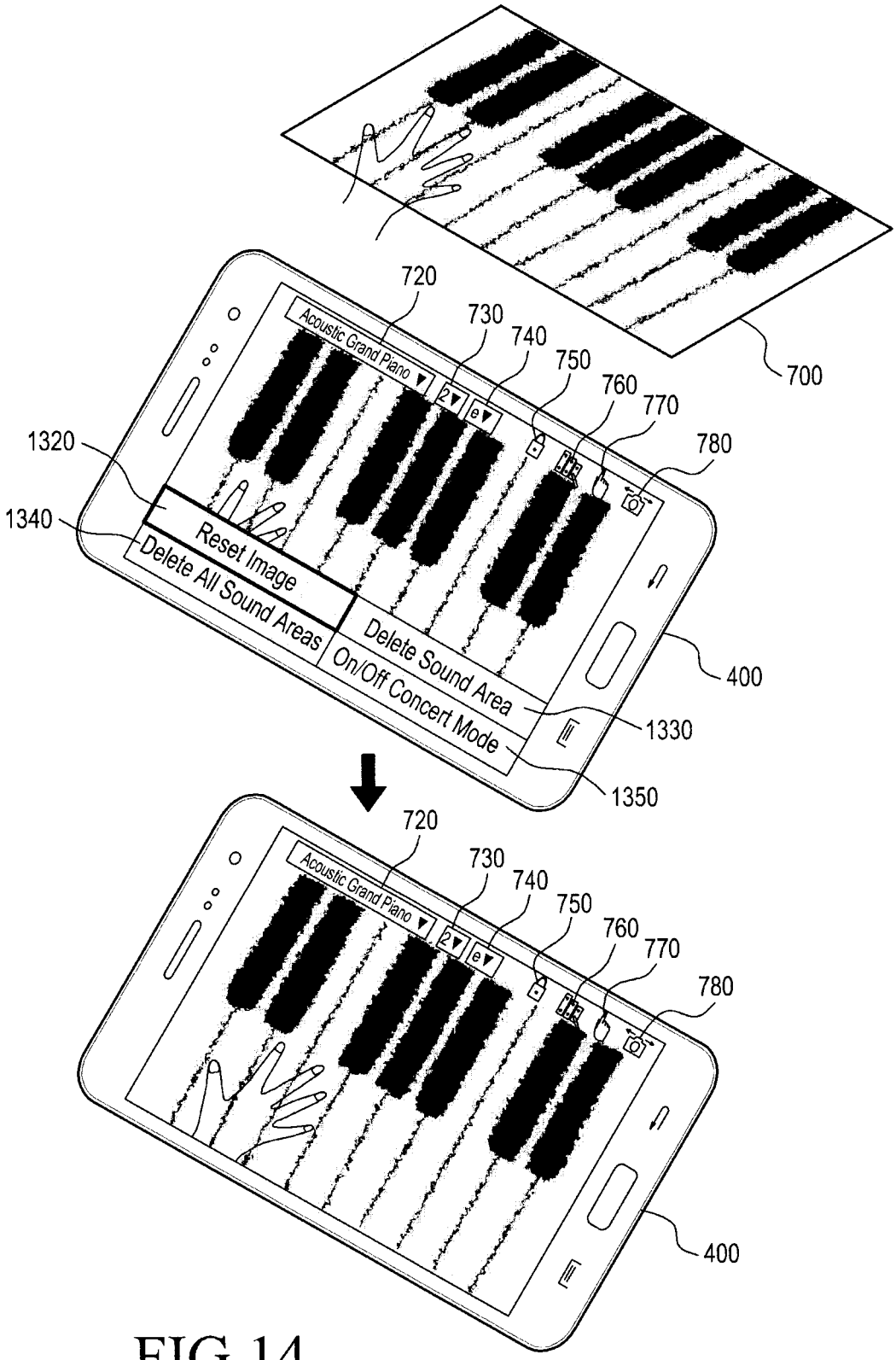
FIG. 14 is a diagram of an example of a user interface for resetting a reference image, according to aspects of the disclosure.

FIG. 14 is a diagram of an example of a user interface for resetting a reference image, according to aspects of the disclosure.

Referring to FIG. 14, if the user wants to change the external image 700, the user may change a reference image for differential image generation by selecting the image reset menu 1320. If the external image 700 is changed (e.g., by placing the user's hand on the external image 700), the user may select the image reset menu 1320 from among the user menus, as illustrated in FIG. 14. Before the image reset menu 1320 is selected, the image processor 412 generate a differential image based on a chrominance value and the input object recognizer 415 recognizes the user's hand as an input object. Thus, the sound output unit 444 may output a sound corresponding to a sound area 1000. On the other hand, upon receipt of an image reset request from the user, the image processor 412 may store a current screen displayed on the display 442 as a reference image. Since the current state of the changed external image 700 becomes the reference image, the sound corresponding to the sound area 1000 on which the user's hand is placed may not be output. That is, as the image reset menu 1320 is selected, the user may change a reference image and perform based on the changed external image 700.

Figure 15:
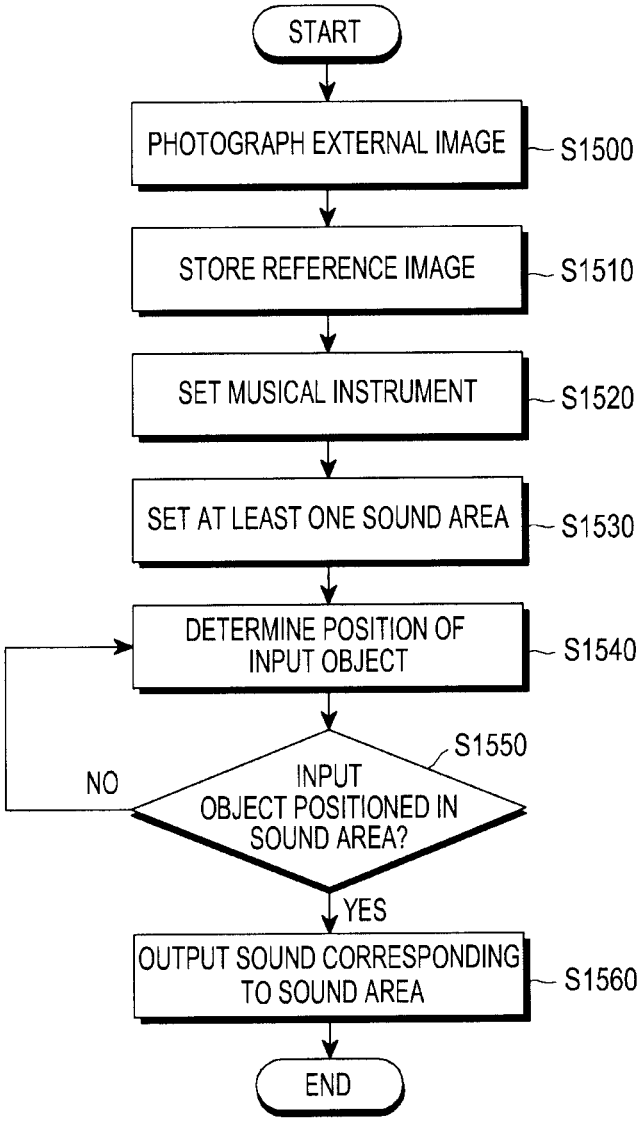
FIG. 15 is a flowchart of an example of a process, according to aspects of the disclosure.

FIG. 15 is a flowchart of an example of a process, according to aspects of the disclosure. According to the process, a photograph of the external image 700 is captured (S1500) for use as a reference image (S1510). Subsequently, a musical instrument may be set according to a user's request (S1520). While piano, xylophone, and drum are shown as available musical instruments in the present disclosure, they are purely exemplary. After the musical instrument is set, at least one sound area 1000 may be set according to a user's request (S1530). The meaning of a sound area has been described before. Sound data related to the same or different octaves and/or scales may be stored by mapping the sound data to different sound areas 1000. Once the at least one sound area 1000 is set, the position of an input object may be determined (S1540). The input object preferably includes an LED that emits a color (for example, red) and the other part of the input object except for the LED is monochrome (for example, gray). A point of the external image 700 corresponding to a sound area 1000 in which the input object 1100 is positioned may be determined (S1550). If the input object 1100 is positioned at a location in the external image 700 corresponding to a sound area 1000, a stored sound mapped to the sound area 1000 in which the input object 1100 is positioned may be output (S1560). If the input object 1100 is not positioned at a point of the external image 700 corresponding to a sound area 1000, the position of the input object 1100 in the external image 700 may be determined again. After the sound is output (S1560), the operation for photographing the external image 700, extracting a differential image using the acquired image, and then determining the position of the input object 1100 may be repeated (S1540).

Figure 16:
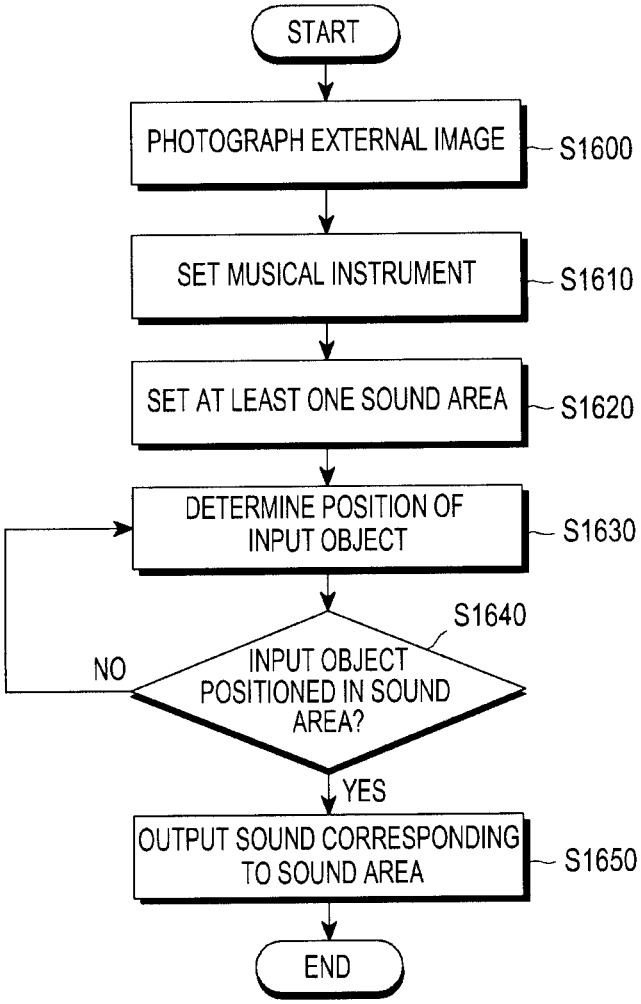
FIG. 16 is a flowchart of an example of a process, according to aspects of the disclosure.

In some embodiments, the input object 1100 is recognized based on a specific color emitted from the input object 1100, even though the external image 700 is not monochrome. The specific color may be received and set, for example, from a color list recognizable to the image processor 412 by the user. Or the specific color may be preset in the process of manufacturing the apparatus 400. According to the above embodiment of the present disclosure, the user may draw a figure(s) on paper as a background of the external image 700 in a color other than the specific color and may play using the input object 1100 emitting the specific color. According to another embodiment of the present disclosure, the method for controlling play of a musical instrument in the apparatus may not include the reference image storing step S1510 illustrated in FIG. 16. In step S1630 for determining the position of the input object 1100, the position of the input object 1100 may be determined by tracking the preset color or a user-set color. To track the preset color or a user-set color, the image processor 412 may be configured to acquire the pixel coordinates of the preset color or the user-set color, and the input object recognizer 415 may determine the position of the input object 1100 based on the pixel coordinates. The other operations illustrated in FIG. 16 may be understood by the foregoing description of FIG. 15 and thus will not be described in detail herein.

According to another embodiment of the present disclosure, an image of a changed external image may be reset by means of the image reset icon 1320 as in the foregoing embodiment. However, the input object 1100 is not recognized by generating a differential image in this embodiment. Thus, resetting an image of a changed external image may not mean "resetting a reference image".

Figure 17A:
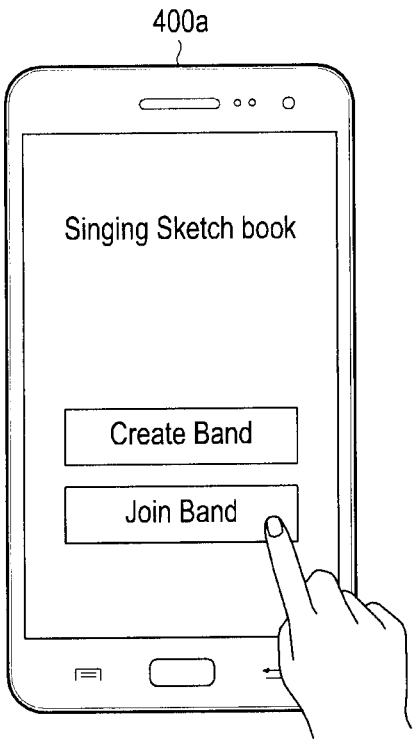
FIG. 17A is a diagram of an example of a user interface for creating and/or joining a music band, according to aspects of the disclosure.
Figure 17B:
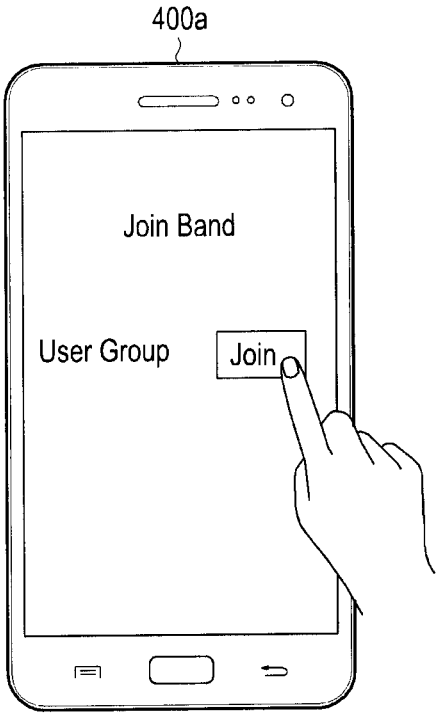
FIG. 17B is a diagram of an example of a user interface for creating a simulating music band, according to aspects of the disclosure.
Figure 17C:
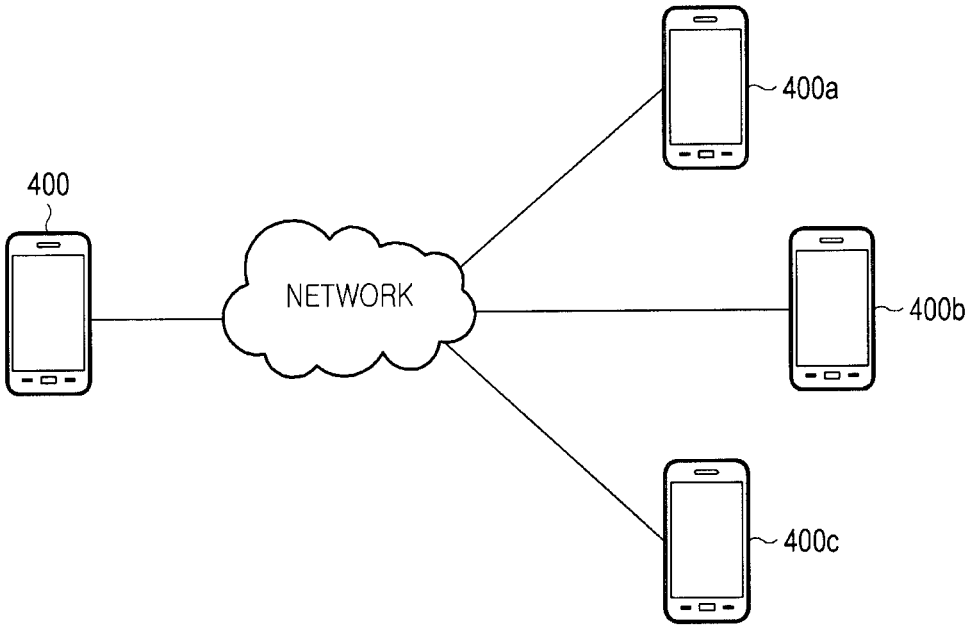
FIG. 17C is a diagram of an example of an example of a system for simulating a music band, according to aspects of the disclosure.

FIGS. 17A, 17B, and 17C are diagrams illustrating an operation for connecting an apparatus according to an embodiment of the present disclosure to one or more other apparatuses.

Referring to FIG. 17A, a user of another apparatus 400*a* (referred to as a "second apparatus") may select a "Join Band" icon to join a "music band" set by the apparatus 400. When the user selects the "Create Band" icon (see FIG. 5), the first apparatus 400 may begin functioning as an AP for the "music band". In other words, the first apparatus 400 may serve as a host device for the music band and, upon selection of "Join Band" as illustrated in FIG. 17A, the second apparatus 400*a* may join the music band created by the first apparatus 400. "Joining the music band" means that the second apparatus 400*a* may be connected to the first apparatus 400 wirelessly or via a wired connection. The second apparatus 400*a* may transmit and receive various data related to music performance to and from the first apparatus 400. The music performance group (for example, "User Group") created by the first apparatus 400 may be displayed on the second apparatus 400*a*, as illustrated in FIG. 17B. Upon receipt of a request for joining the music band from the user (for example, by user selection of a "Join" icon), the second apparatus 400*a* may transmit a wired or wireless connection request to the first apparatus 400. The first apparatus 400 may receive the request and transmit a response to the second apparatus 400*a*.

While it has been described with reference to FIGS. 17A and 17B that one guest device (for example, the second apparatus 400*a*) is connected to a host device (for example, the first apparatus 400), this does not limit the embodiment of the present disclosure. That is, it is apparent that various guest devices 400*a*, 400*b*, and 400*c* may join the music performance group, as illustrated in FIG. 17C.

FIGS. 18A to 20 are diagrams illustrating various embodiments that may be implemented by sharing music performance data between an apparatus according to an embodiment of the present disclosure and one or more other apparatuses. A description will be given of FIGS. 18A to 20 with the appreciation that the various guest devices 400*a*, 400*b*, and 400*c* are connected to the host device 400 wirelessly or via a wired connection, as described before with reference to FIGS. 17A, 17B, and 17C.

Figure 18A:
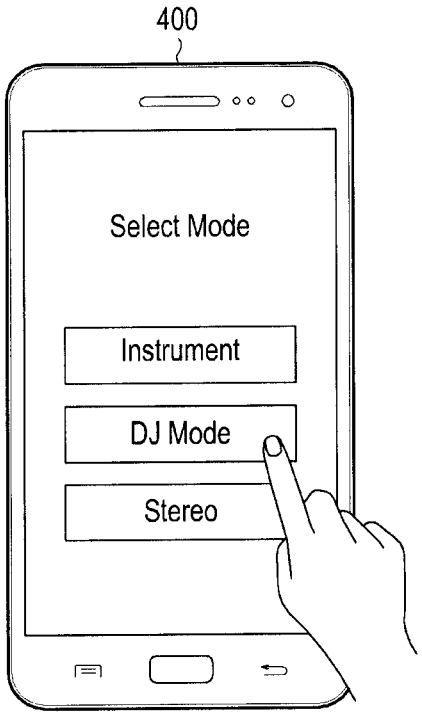
FIG. 18A is a diagram of an example of a user interface for simulating a music band, according to aspects of the disclosure.
Figure 18B:
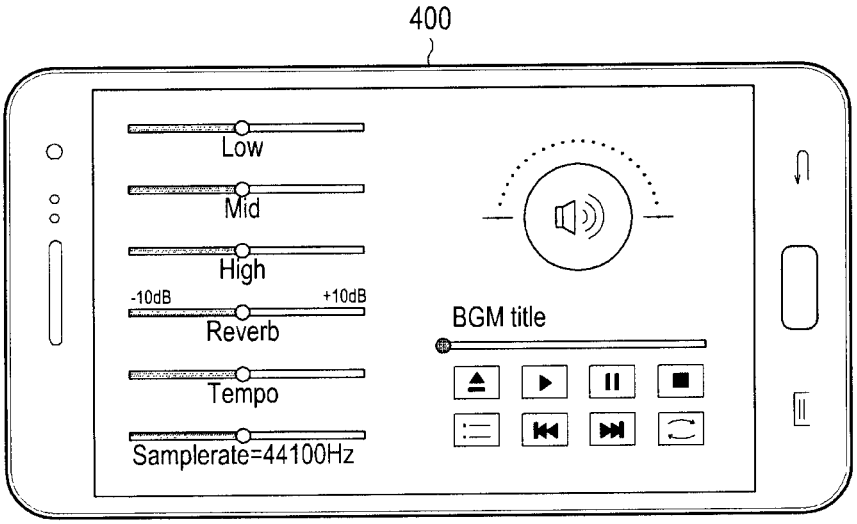
FIG. 18B is a diagram of an example of a user interface for simulating a music band, according to aspects of the disclosure.
Figure 18C:
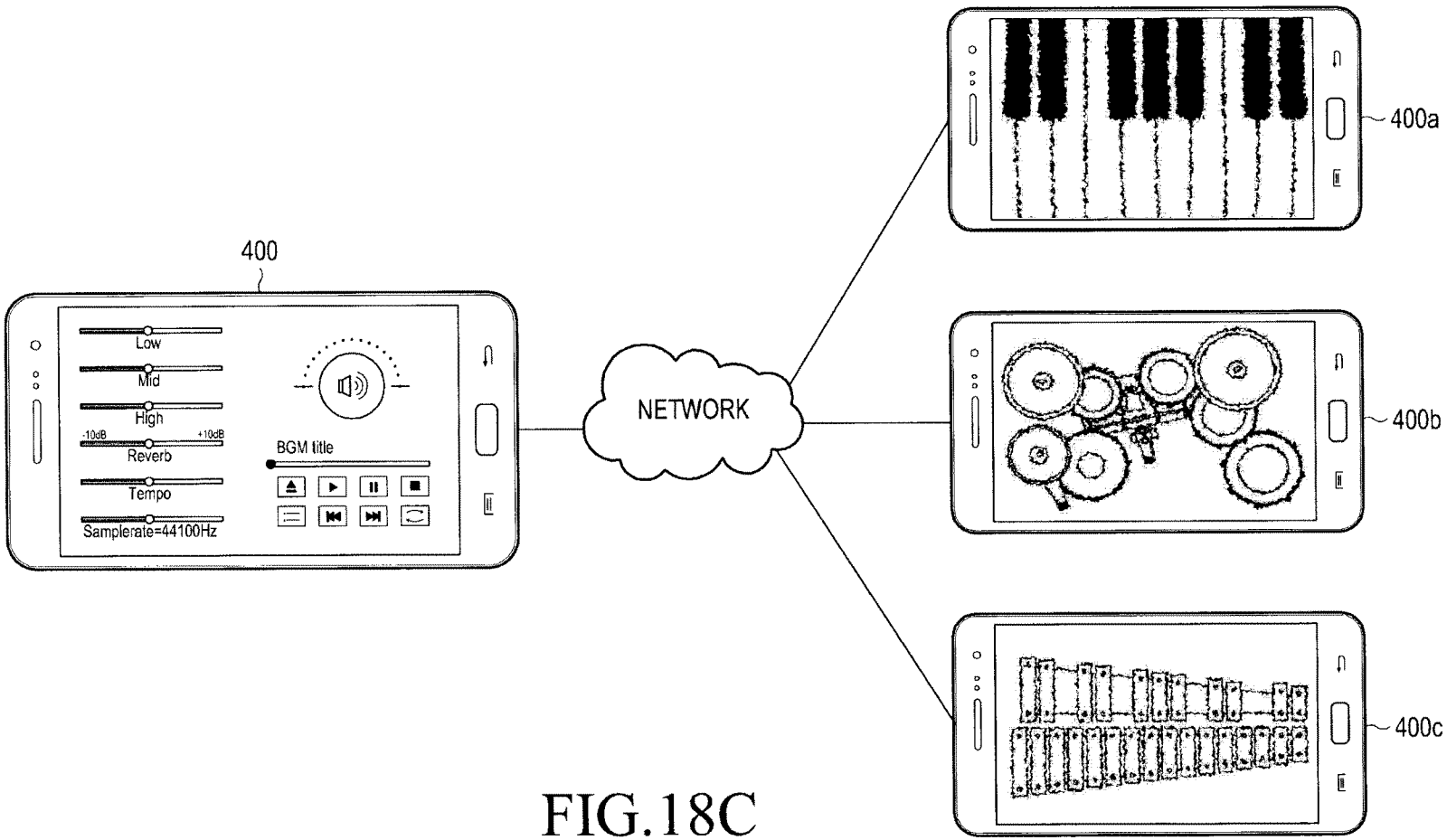
FIG. 18C is a diagram of an example of a user interface for simulating a music band, according to aspects of the disclosure.

Referring to FIG. 18A, the first apparatus 400 may receive a selection to control the guest devices 400*a*, 400*b*, and 400*c* (for example, a user selection of "DJ mode"). Then the first apparatus 400 may display various icons for controlling the guest devices 400*a*, 400*b*, and 400*c* as illustrated in FIG. 18B. The icons may include, for example, a volume control icon, a tempo control icon, a play type setting icon, and the like. As illustrated in FIG. 18C, the guest devices 400*a*, 400*b*, and 400*c* may display music interfaces (not shown) (for example, images of a piano, a drum, and a xylophone) in the manner described before with reference to FIGS. 5A to 16, as illustrated in FIG. 18C.

If one (for example, 400*a*) of the guest devices 400*a*, 400*b*, and 400*c* performs music, the other devices 400, 400*b*, and 400*c* may share sound data of the music performance. Sharing sound data means that sounds of all musical instruments included in the music performance group are output from each device. For example, when the guest device 400*a* corresponding to a piano and the guest device 400*b* corresponding to a drum play the musical instruments at the same time, each of the devices 400*a* and 400*b* may output the sounds of the piano and the drum. Therefore, the musical instruments are played in an ensemble through each of the devices 400, 400*a*, 400*b*, and 400*c*. Information about the music performance may be transmitted and received between the devices, for example, through their communication units (not shown).

The host device 400 may reproduce (or output) a music file stored in the host device 400 or another electronic device (for example, a music content providing server). Upon receipt of a music play request from a user, the host device 400 may display a list of available music files and reproduce a music file selected from the list. The host device 400 and the guest devices 400*a*, 400*b*, and 400*c* may play the musical instruments in an ensemble while the selected music file is being reproduced. That is, music selected by the user may serve as a BackGround Music (BGM) in the ensemble. However, the "music file" is a mere embodiment of acoustic data reproducible by each of the devices 400, 400*a*, 400*b*, and 400*c*. According various embodiments of the present disclosure, many other acoustic data than a music file may be reproduced. The volume of the reproduced acoustic data may be controlled by, for example, a volume control menu 1810 illustrated in FIG. 18E. FIGS. 18D to 18G illustrate various embodiments of performing an ensemble. More specifically, FIGS. 18D to 18G are views referred to for describing an embodiment of controlling a volume through the host device 400 while an ensemble is being performed.

Figure 18D:
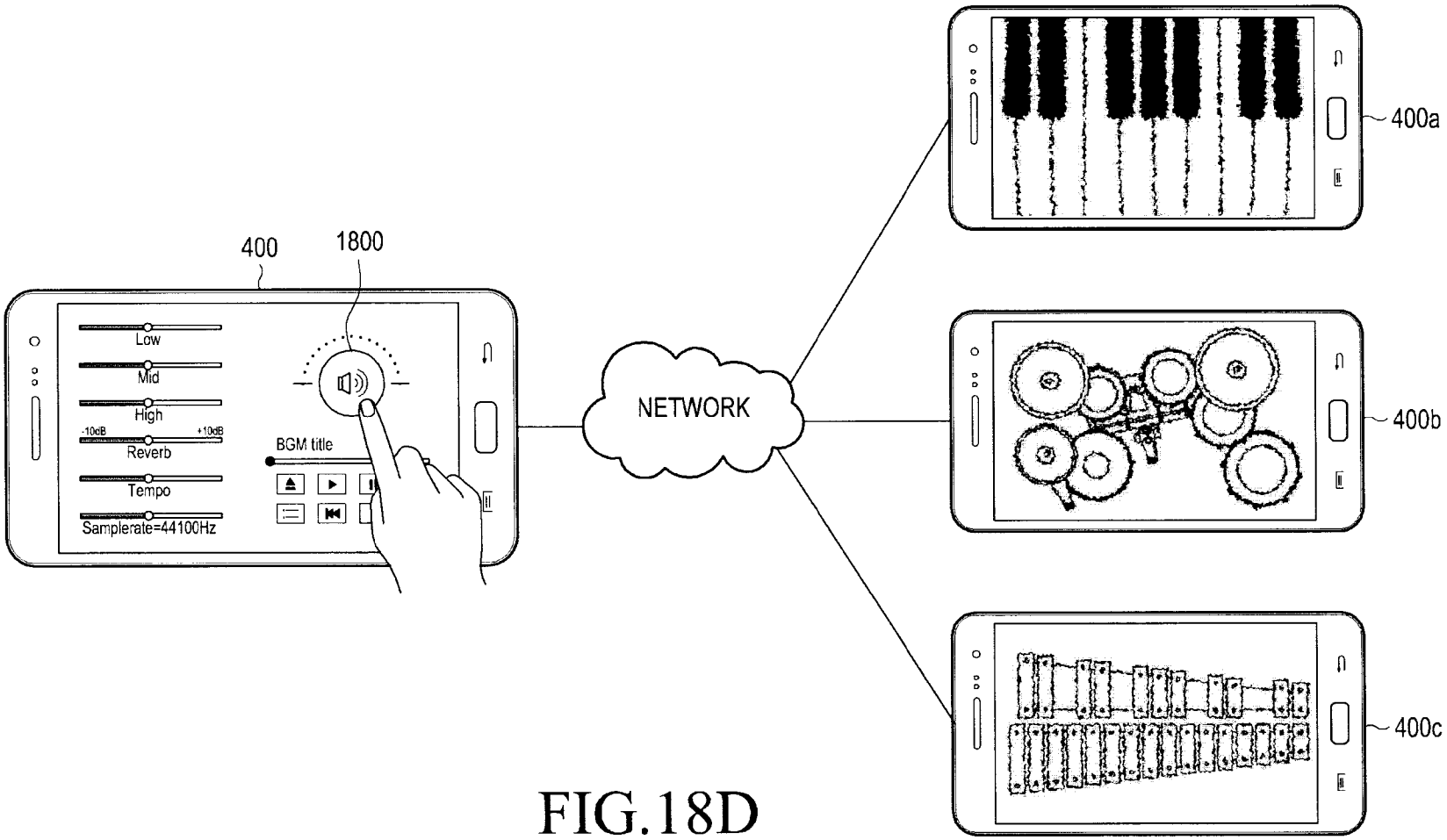
FIG. 18D is a diagram of an example of a user interface for simulating a music band, according to aspects of the disclosure.
Figure 18E:
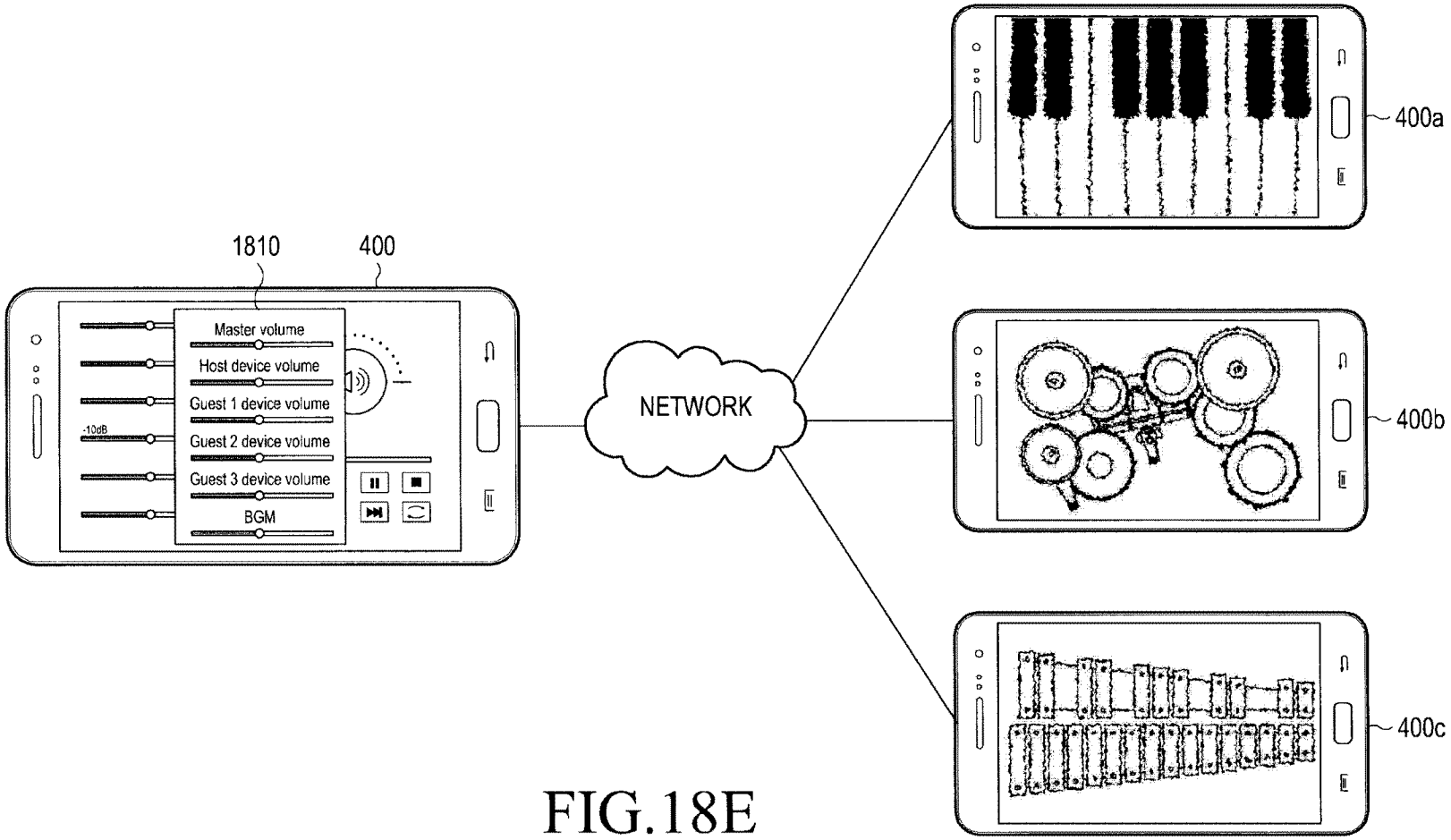
FIG. 18E is a diagram of an example of a user interface for simulating a music band, according to aspects of the disclosure.

Referring to FIG. 18D, the host device 400 may receive a selection of a volume control icon 1800. Then, the display 442 of the host device 400 may display the volume control menu 1810 as illustrated in FIG. 18E. The volume control menu 1810 may include a master volume item, a host device volume item, and volume items for the guest devices 400*a*, 400*b*, and 400*c*. Each volume item may be displayed as a bar type. The menu items of the volume control menu and the displayed type of the menu items are exemplary for the description of the present disclosure and may be modified according to each embodiment.

Figure 18F:
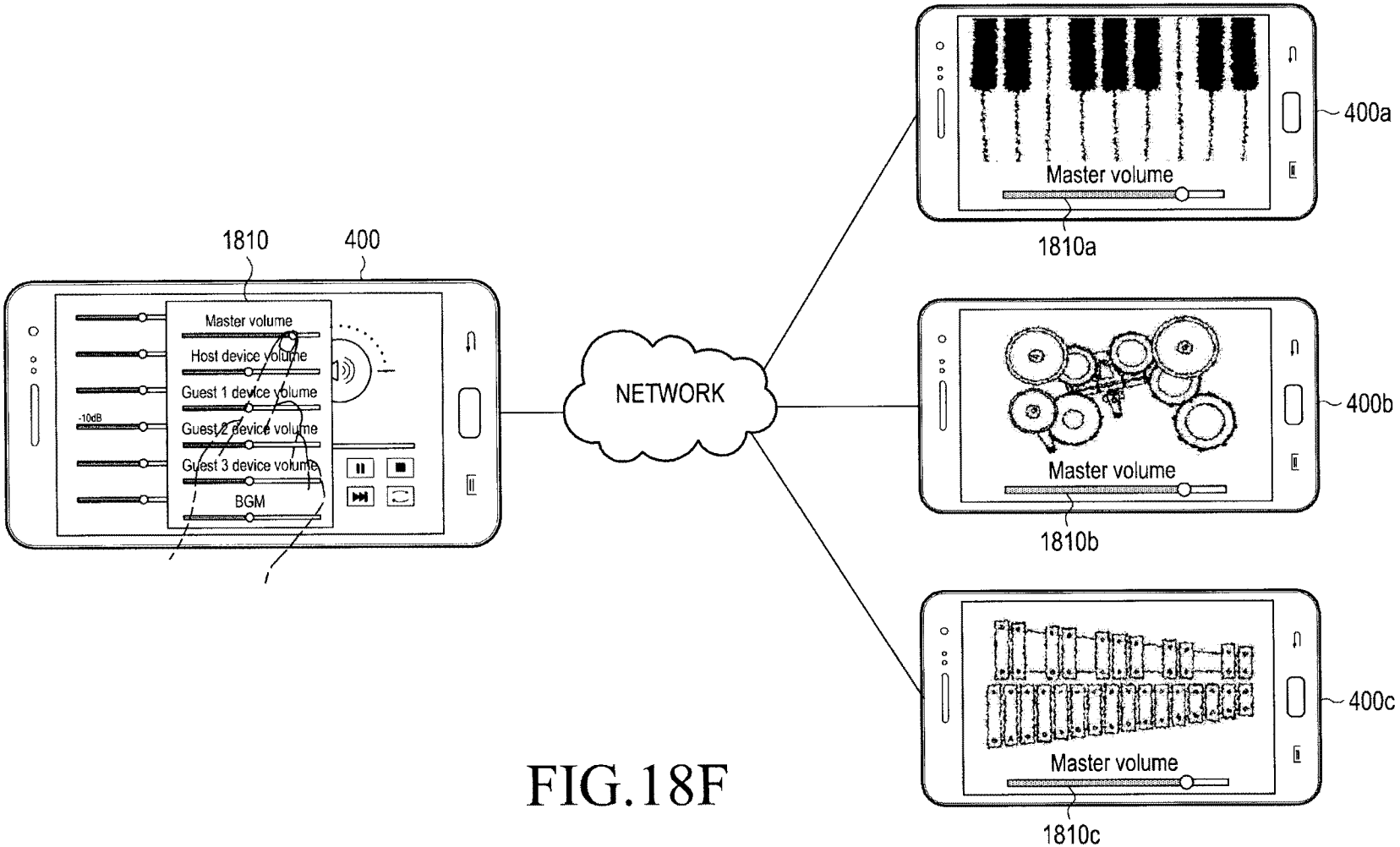
FIG. 18F is a diagram of an example of a user interface for simulating a music band, according to aspects of the disclosure.

Upon receipt of a volume control request for the master volume, the host device 400 may control the volumes of the respective devices 400*a*, 400*b*, and 400*c* and the volume of the host device 400, as illustrated in FIG. 18F.

Figure 18G:
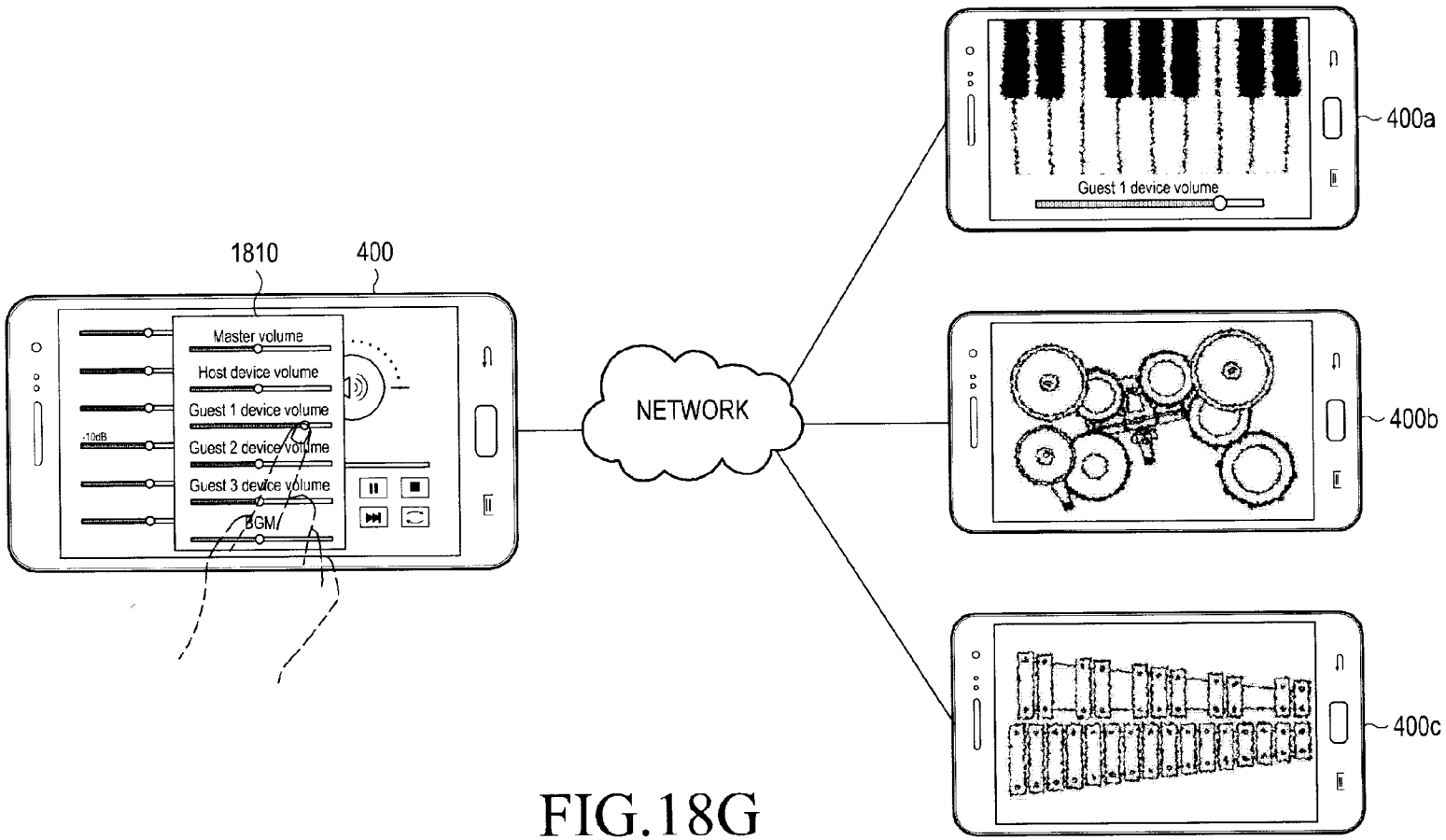
FIG. 18G is a diagram of an example of a user interface for simulating a music band, according to aspects of the disclosure.

Referring to FIG. 18G illustrating another embodiment of volume control, upon receipt of a volume control request for a guest device volume (for example, the volume of the guest device 400*a*), the host device 400 may control the volume of the selected guest device 400*a*.

In another embodiment of volume control, if the concert mode is off in any device (for example, the guest device 400*a*) in relation to the concert mode on/off icon 1350, the device (that is, the guest device 400*a*) may not output sounds of the musical instruments played in the other devices. For example, if the concert mode is off in the guest device 400*a*, the guest device 400*a* may output only sounds of the musical instrument, that is, the piano played in the guest device 400*a* without outputting sounds of the musical instruments (for example, a drum and a xylophone) played in the other devices (for example, the guest devices 400*b* and 400*c*). A function(s) or operation(s) related to the volume control may be performed preferably by the sound controller 416.

Figure 19A:
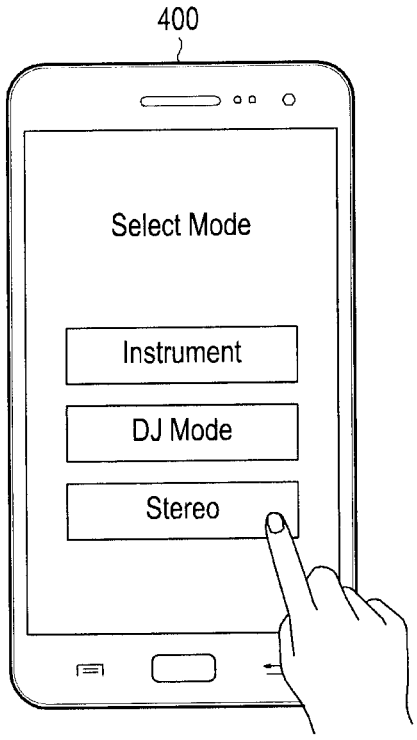
FIG. 19A is a diagram of an example of a user interface for simulating a music band, according to aspects of the disclosure.
Figure 19B:
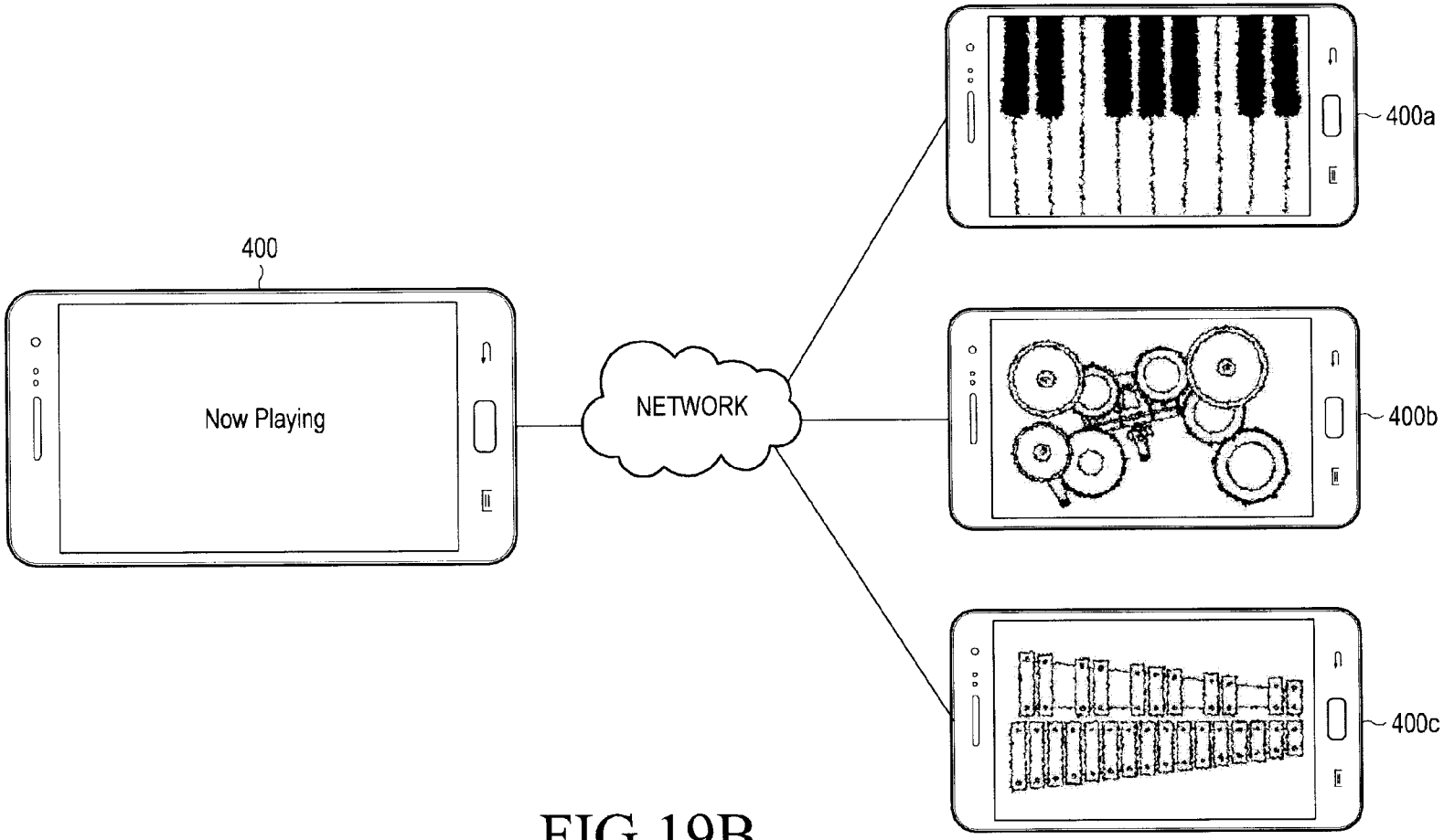
FIG. 19B is a diagram of an example of a user interface for simulating a music band, according to aspects of the disclosure.

Referring to FIGS. 19A and 19B, the host device 400 may be operable in a mode for only reproducing an ensemble played by the guest devices 400*a*, 400*b*, and 400*c* (for example, the "Stereo" mode), unlike the embodiment illustrated in FIGS. 18A to 18F. As illustrated in FIG. 19B, icons for the guest devices 400*a*, 400*b*, and 400*c* may not be displayed in the "Stereo" mode.

Figure 20:
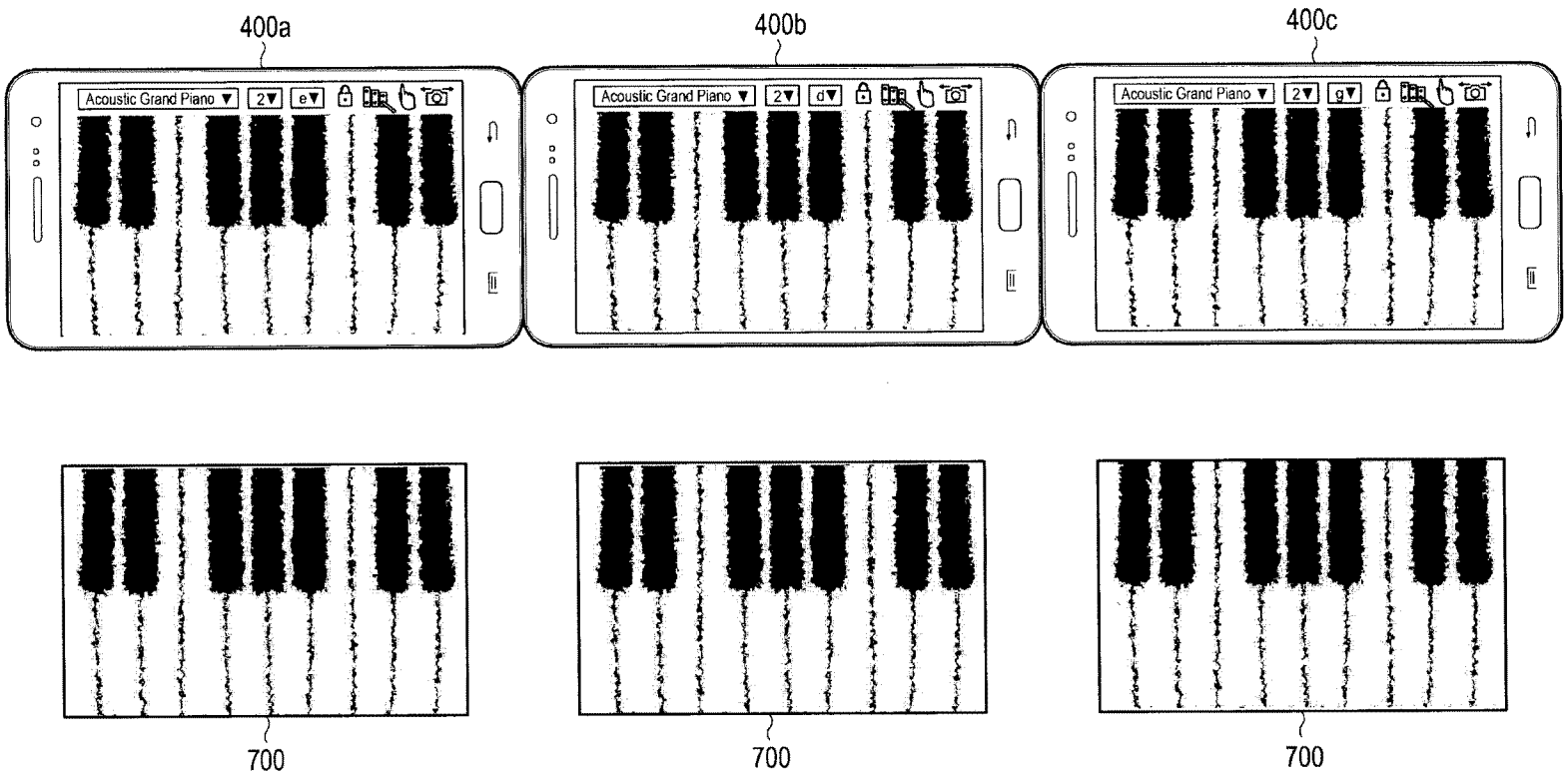
FIG. 20 is a diagram of an example of a user interface for simulating a music band, according to aspects of the disclosure.

FIG. 20 illustrates another embodiment of performing an ensemble in the guest devices 400*a*, 400*b*, and 400*c*. Compared to the embodiments illustrated in FIGS. 18A to 18F in which the guest devices 400*a*, 400*b*, and 400*c* play different musical instruments independently, the guest devices 400*a*, 400*b*, and 400*c* may play the same musical instrument (for example, a piano).

As is apparent from the foregoing description of the present disclosure, since a user performs music using an external image made freely by the user, a larger play area than in a conventional technology can be secured.

FIGS. 1-20 are provided as an example only. At least some of the steps discussed with respect to these figures can be performed concurrently, performed in a different order, and/or altogether omitted. It will be understood that the provision of the examples described herein, as well as clauses phrased as "such as," "e.g.", "including", "in some aspects," "in some implementations," and the like should not be interpreted as limiting the claimed subject matter to the specific examples.

The above-described aspects of the present disclosure can be implemented in hardware, firmware or via the execution of software or computer code that can be stored in a recording medium such as a CD-ROM, a Digital Versatile Disc (DVD), a magnetic tape, a RAM, a floppy disk, a hard disk, or a magneto-optical disk or computer code downloaded over a network originally stored on a remote recording medium or a non-transitory machine-readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in whole or in part within the programmed instructions of a computer. No claim element herein is to be construed under the provisions of 35 U.S.C. 112, sixth paragraph, unless the element is expressly recited using the phrase "means for".

While the present disclosure has been particularly shown and described with reference to the examples provided therein, it will be understood by those skilled in the art that various changes in form and details may be made therein without departing from the spirit and scope of the present disclosure as defined by the appended claims.

What is claimed is:

1. An apparatus for simulating a musical instrument, comprising:

a touch screen configured to present a musical interface associated with an external image;

a speaker configured to output a sound; and a controller configured to associate the musical interface with the musical instrument, in response to an input being detected that selects a portion of the musical interface among a plurality of portions of the musical interface, to associate the selected portion of the musical interface with a sound, and adjust an octave or a scale of at least one of the plurality of portions different from the selected portion of the musical interface based on the associated sound; and to control the speaker to output the associated sound in response to a contact being detected between an object and a portion of the external image that corresponds to the portion of the musical interface.

2. The apparatus of claim 1, wherein the controller is further configured to detect the contact between the object and the portion of the external image that corresponds to the portion of the musical interface.

3. The apparatus of claim 1, further comprising an image acquirer configured to photograph the external image.

4. The apparatus of claim 3, wherein the controller is further configured to generate a differential image based on a plurality of photographs of the external image, wherein the differential image is used to detect the contact between the object and the portion of the external image that corresponds to the portion of the musical interface.

5. The apparatus of claim 1, wherein the controller is further configured to control a property of the associated sound, wherein the property includes at least one of octave and scale.

6. The apparatus of claim 5, further comprising a communication unit configured to exchange data related to an ongoing musical performance between the apparatus and at least one other apparatus that is operable to simulate another musical instrument.

7. The apparatus of claim 1, wherein the controller is further configured to receive user authentication information and authenticate a user based on the user authentication information.

8. The apparatus of claim 1, wherein the controller is further configured to detect a predetermined color that is output from the object.

9. A method for simulating a musical instrument comprising:

displaying, by an electronic device, a musical interface that is associated with an external image; and associating the musical interface with the musical instrument;

in response to detecting an input selecting a portion of the musical interface among a plurality of the portions of the musical interface, associating the selected portion of the musical interface with a sound;

adjusting an octave or a scale of at least one of the plurality of portions different from the selected portion of the musical interface based on the associated sound; and outputting the associated sound in response to detecting a contact between an object and a portion of the external image that corresponds to the portion of the musical interface.

10. The method of claim 9, further comprising detecting the contact between the object and the portion of the external image that corresponds to the portion of the musical interface.

11. The method of claim 9, further comprising acquiring a plurality of photographs of the external image.

12. The method of claim 11, further comprising generating a differential image based on the plurality of photographs.

13. The method of claim 9, further comprising controlling a property of the associated sound, wherein the property is at least one of octave and scale.

14. The method of claim 9, further comprising receiving user authentication information and authenticating a user based on the user authentication information.

15. The method of claim 9, wherein the contact between the object and the portion of the external image that corresponds to the portion of the musical interface is detected by sensing a change of color in the external image.

16. The method of claim 9, further comprising exchanging data related to an ongoing musical performance between the electronic device and at least one other electronic device that is operable to simulate another musical instrument.

* * * * *